US005157948A

United States Patent [19]

Rikiishi et al.

[11] Patent Number: 5,157,948

[45] Date of Patent: Oct. 27, 1992

[54] APPARATUS FOR WINDING AND CONVEYING KNITTED FABRIC FOR KNITTING MACHINE

[75] Inventors: Tsutomu Rikiishi; Takashi Sato; Akihiro Yoshihara; Masami Hashimoto, all of Bunsui, Japan

[73] Assignee: Nagata Seiki Kabushiki Kaisha, Tokyo, Japan

[21] Appl. No.: 810,507

[22] Filed: Dec. 19, 1991

[30] Foreign Application Priority Data

| | | | |
|---|---|---|---|
| Dec. 27, 1990 | [JP] | Japan | 2-408341 |
| Jan. 8, 1991 | [JP] | Japan | 3-000730 |
| Jan. 8, 1991 | [JP] | Japan | 3-000737 |
| Apr. 30, 1991 | [JP] | Japan | 3-126827 |

[51] Int. Cl.[5] ..... D04B 15/88; B65H 19/22

[52] U.S. Cl. ..... 66/151; 242/56 R

[58] Field of Search ..... 66/151, 152, 153; 242/56 R, 78.1

[56] References Cited

U.S. PATENT DOCUMENTS

| | | | |
|---|---|---|---|
| 2,158,177 | 5/1939 | Firsching | 66/151 |
| 3,695,062 | 10/1972 | Schaack | 66/151 |
| 4,105,172 | 8/1978 | Petros | 242/78.1 |
| 4,618,105 | 10/1986 | Kuhn | 242/56 R |
| 4,711,404 | 12/1987 | Falk | 242/56 R |
| 4,749,139 | 6/1988 | Snygg | 242/56 R |
| 5,016,831 | 5/1991 | Saukkonen | 242/56 R X |

FOREIGN PATENT DOCUMENTS

| | | | |
|---|---|---|---|
| 0130873 | 8/1983 | Japan | 242/56 R |

*Primary Examiner*—Werner H. Schroeder
*Assistant Examiner*—John J. Calvert
*Attorney, Agent, or Firm*—Ladas & Parry

[57] ABSTRACT

An apparatus for winding into a roll a knitted fabric produced in a circular knitting machine and for conveying the roll to the outside of the knitting machine. A knitted fabric hangs below the knitting machine and is wound around a pair of horizontally aligned takeup shafts that are shiftable away from each other and toward each other until they are thrust against each other. At the start of the winding operation, the takeup shafts are shifted toward each other, and when the shafts approach positions to leave a gap between inner gripping ends of these shafts, a knitted fabric insertion link mechanism provided alongside the takeup shafts is extended toward the gap, and a fabric thrust arm on a distal end of the link mechanism pushes and insert a portion of the lower starting end of the hanging fabric into the gap. Thereafter the gap is closed so that the lower starting end of the fabric is firmly gripped between the gripping ends to enable start of the winding operation.

17 Claims, 29 Drawing Sheets

APPARATUS FOR WINDING AND CONVEYING KNITTED FABRIC FOR KNITTING MACHINE

BACKGROUND OF THE INVENTION

The present invention relates to an apparatus for winding and conveying a knitted fabric produced in a knitting machine, particularly a circular knitting machine.

As is well known in the art, a circular knitting machine has an upright needle cylinder or cylinders carrying vertical knitting needles therearound. As the needle cylinder or cylinders rotate, the knitting needles are reciprocated vertically to knit a fabric of cylindrical shape. The fabric thus knitted is fed downward and hangs or depends in a space below the needle cylinder. The depending fabric is passed between a pair of nip rolls to be flattened and then wound around takeup shafts that are aligned horizontally and have confronting opposite ends. The takeup shafts are normally disposed with the opposite ends in abutting contact and rotated to wind the fabric therearound into a roll. When the fabric has been wound up to a full size, it is cut from the trailing part of the knitted fabric and the takeup shafts are pulled outwardly away from each other so that the roll is released and placed on a movable stand having wheels, to be conveyed out of the knitting machine.

The above described type of apparatus for winding a knitted fabric into a roll is disclosed in Japanese Patent Publication No. Hei-1-59372 published Dec. 18, 1989.

In this known knitted fabric winding apparatus, it is necessary to cause a starting end of the knitted fabric to be gripped between the opposite inner gripping ends of the takeup shafts by shifting the shafts toward each other, before the takeup shafts are driven in rotation to start the winding operation. Because the starting end portion of the knitted fabric is hanging downwardly and the inner gripping ends of the takeup shafts are caused to advance inwardly toward the hanging starting end portion, the operation of gripping the starting end portion between the inner gripping ends of the takeup shafts is not carried out reliably.

In order to facilitate the gripping of the starting end portion of the fabric, the inner gripping ends of the takeup shafts are formed with slanted end faces, respectively, which mate with each other to hold the fabric therebetween. The slanted end faces serve to thrust the hanging fabric toward the center axis of the takeup shafts, as the takeup shafts are shifted toward each other. The slanted formation of the inner mating ends of the takeup shafts, however, tends to cause the inner gripping end portions of the takeup shafts to be transversely deflected so as to take offset positions relative to the center axis of the shafts at the instant of gripping the fabric starting end portion, because of force components transverse to the center axis, produced by the slanted end faces. This tends to cause a misgripping and a damage on the fabric.

In the known circular knitting machine, a roll of the knitted fabric prepared in the manner described above is dropped onto a movable stand and conveyed out of the knitting machine as stated before. This is carried out manually and therefore the operation is inefficient. Furthermore, the dropping of the roll imparts a shock to the roll and sometimes causes a damage to the roll.

SUMMARY OF THE INVENTION

The main object of the present invention is to provide an apparatus for winding and conveying a knitted fabric from a knitting machine, wherein the gripping of the starting end of the knitted fabric can be reliably carried out by the inner gripping ends of a pair of takeup shafts without giving rise to misgripping and damage to the fabric An additional object of the present invention is to provide an apparatus of the above kind, wherein the prepared roll of the knitted fabric can be received without shock and conveyed efficiently out of the knitting machine.

According to the present invention, there is provided an apparatus for winding and conveying a knitted fabric produced in a knitting machine, having a pair of horizontally aligned takeup shafts disposed below said knitting machine to wind therearound the knitted fabric which is fed downwardly from the knitting machine, into a roll of the knitted fabric, said takeup shafts having opposite inner gripping ends which are normally thrust against each other to grip therebetween a lower starting end of the knitted fabric, said takeup shafts being shiftable outwardly away from each other and out of the roll formed therearound to release the roll, said apparatus comprising: knitted fabric insertion means provided at one side of said takeup shafts so as to be extendable into, and retractable out of a region in which said gripping ends of the takeup shafts confront each other, said insertion means having a fabric thrust arm on a free distal end thereof; drive means acting on the takeup shafts to shift the same toward and away from each other; actuator means coupled to said knitted fabric insertion means to extend and retract the same, said actuator means being operable to extend the insertion means so as to push said fabric thrust arm into said lower starting end of the fabric, thereby to thrust a portion of said starting end into a gap between said gripping ends of the takeup shafts which are being moved into confrontation with each other, whereby the starting end of the fabric is gripped by the gripping ends preparatory to the winding of the fabric around the takeup shafts; means for cutting a trailing part of the fabric from the roll; and means for conveying the roll out of the knitting machine The present invention will become more apparent from the following description of preferred embodiments thereof taken in conjunction with the accompanying drawings.

DESCRIPTION OF THE PREFERRED EMBODIMENTS

Preferred embodiments of the present invention will now be described below.

Figure 1:
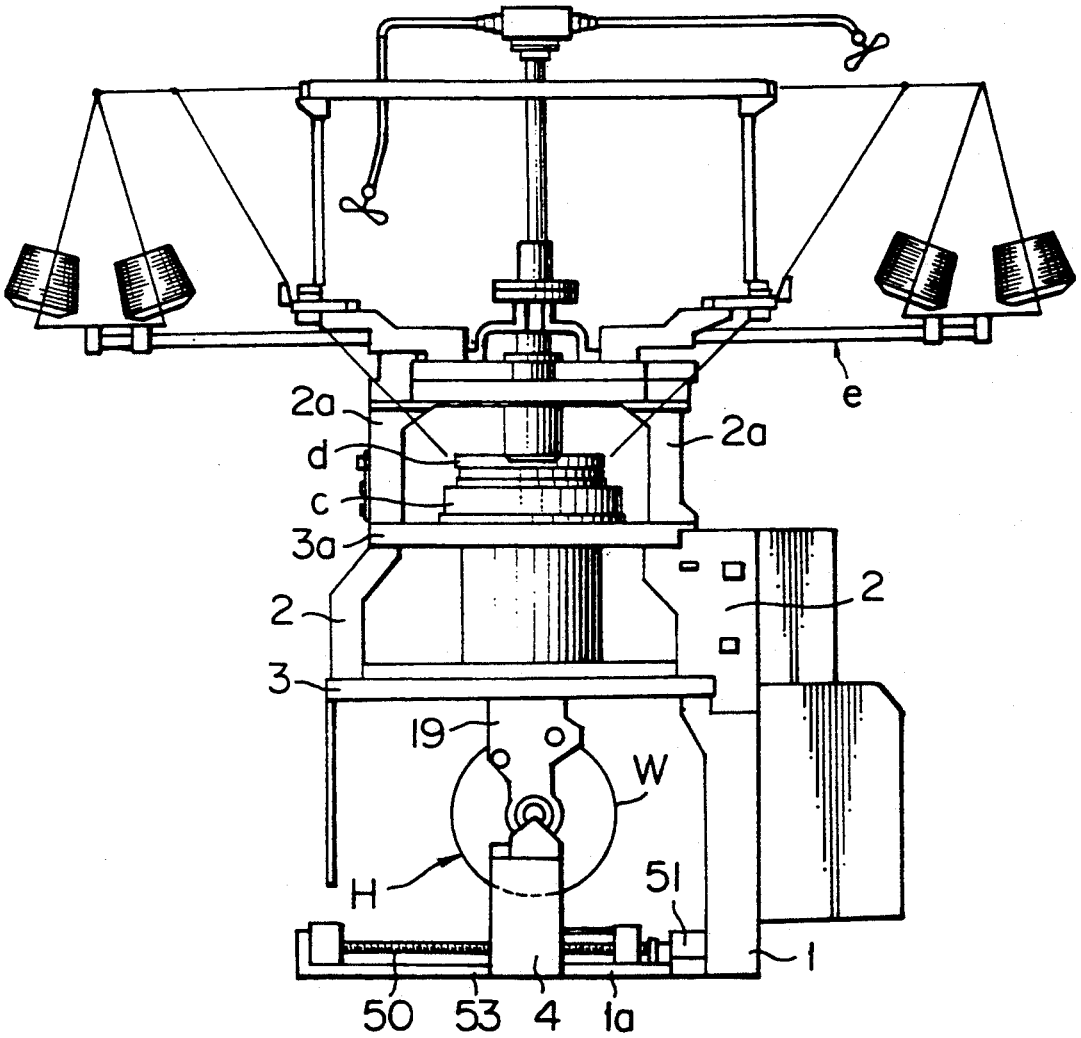
FIG. 1 is an elevational view illustrating the whole construction of a circular knitting machine using the present invention.

Referring to FIG. 1, a circular knitting machine shown has a plurality of legs 1 forming a base frame of the knitting machine, and a supporting frame 2 is securely mounted on the legs 1 through a disk-shaped machine stand 3. Another supporting frame 2*a* is further securely mounted on the supporting frame 2 through a frame 3*a*, and a conventional needle cylinder c is rotatably supported within the frames 2 and 2*a*. The needle cylinder c is formed with a multiplicity of vertical grooves into which knitting needles are fitted, respectively, and vertically slid by means of cam mechanisms (not shown). A conventional dial mechanism d is mounted immediately above the needle cylinder c in such a way that it rotates in synchronism with the cylinder c. Furthermore, conventional dial needles are provided for sliding movement by dial cams in relation to the operation of the knitting needles. Conventional yarn feeding devices e are mounted above the dial mechanism d. A pair of supporting members 19 depend from a rotary member in the machine stand 3 above the legs 1, and a knitted fabric rolling or winding device H for winding the tubular knitted fabric knitted by the knitting machine is provided between the pair of supporting members 19.

Figure 2:
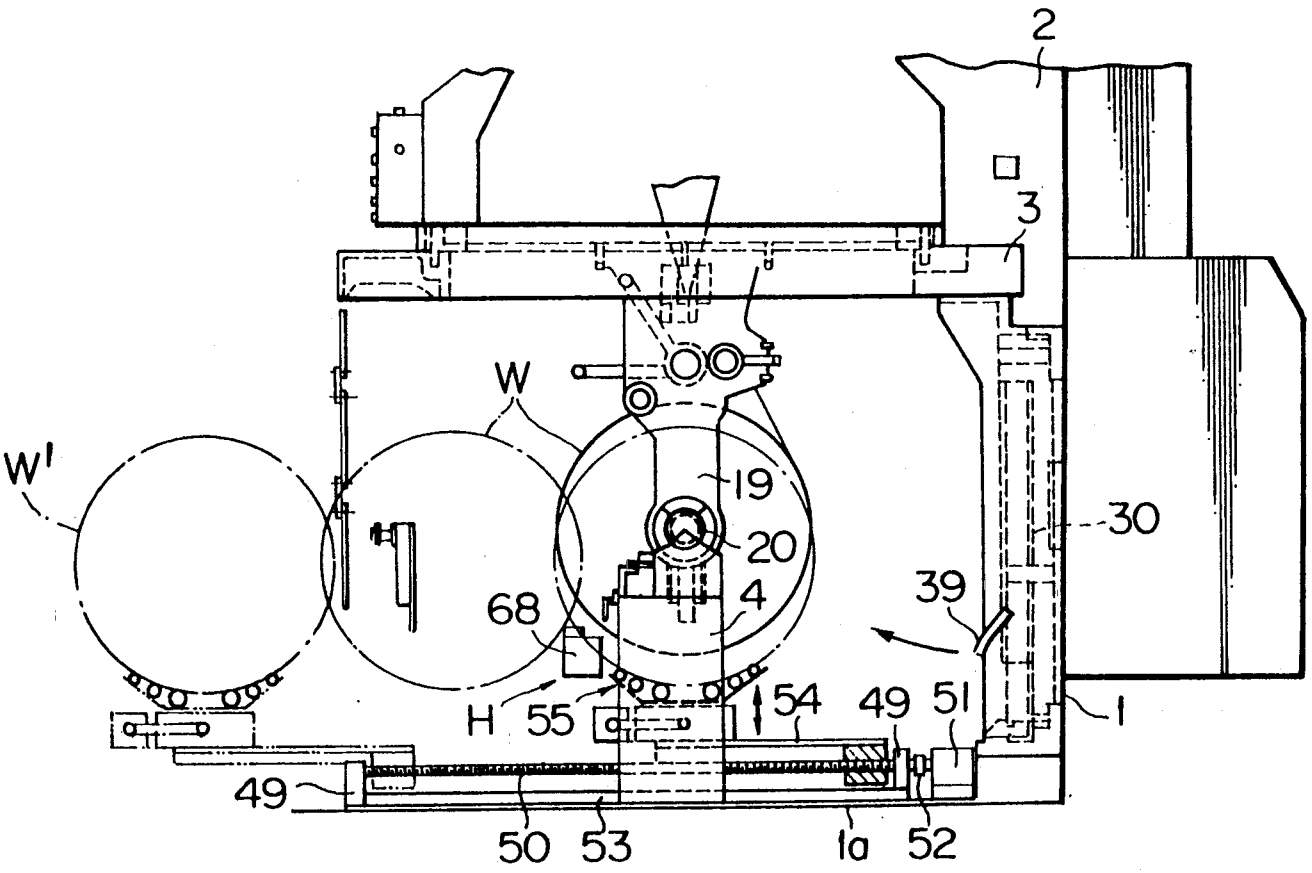
FIG. 2 is an elevational view, on an enlarged scale, of a knitted fabric winding apparatus incorporated in the knitting machine shown in FIG. 1.
Figure 3:
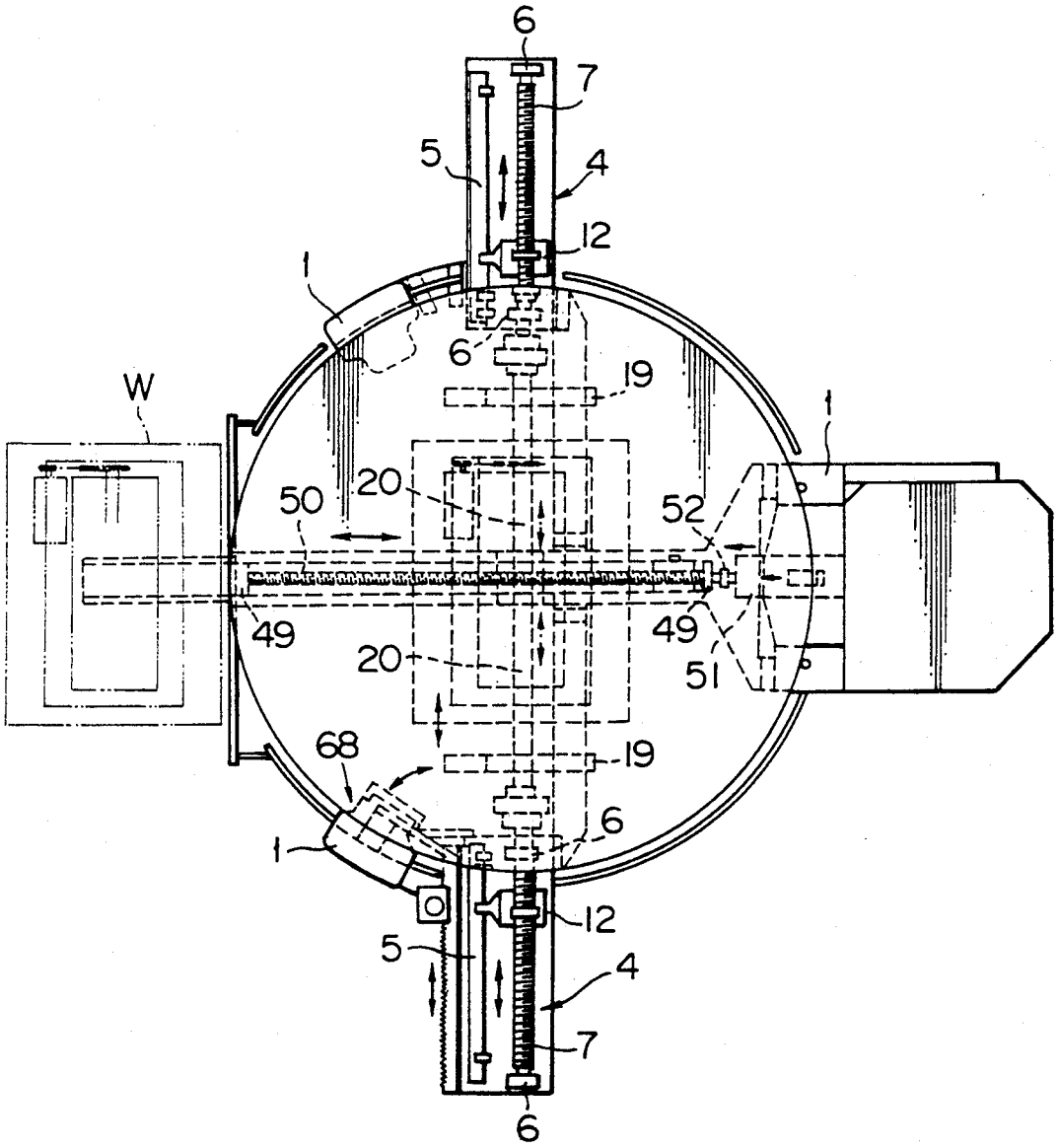
FIG. 3 is a top view thereof.
Figure 4:
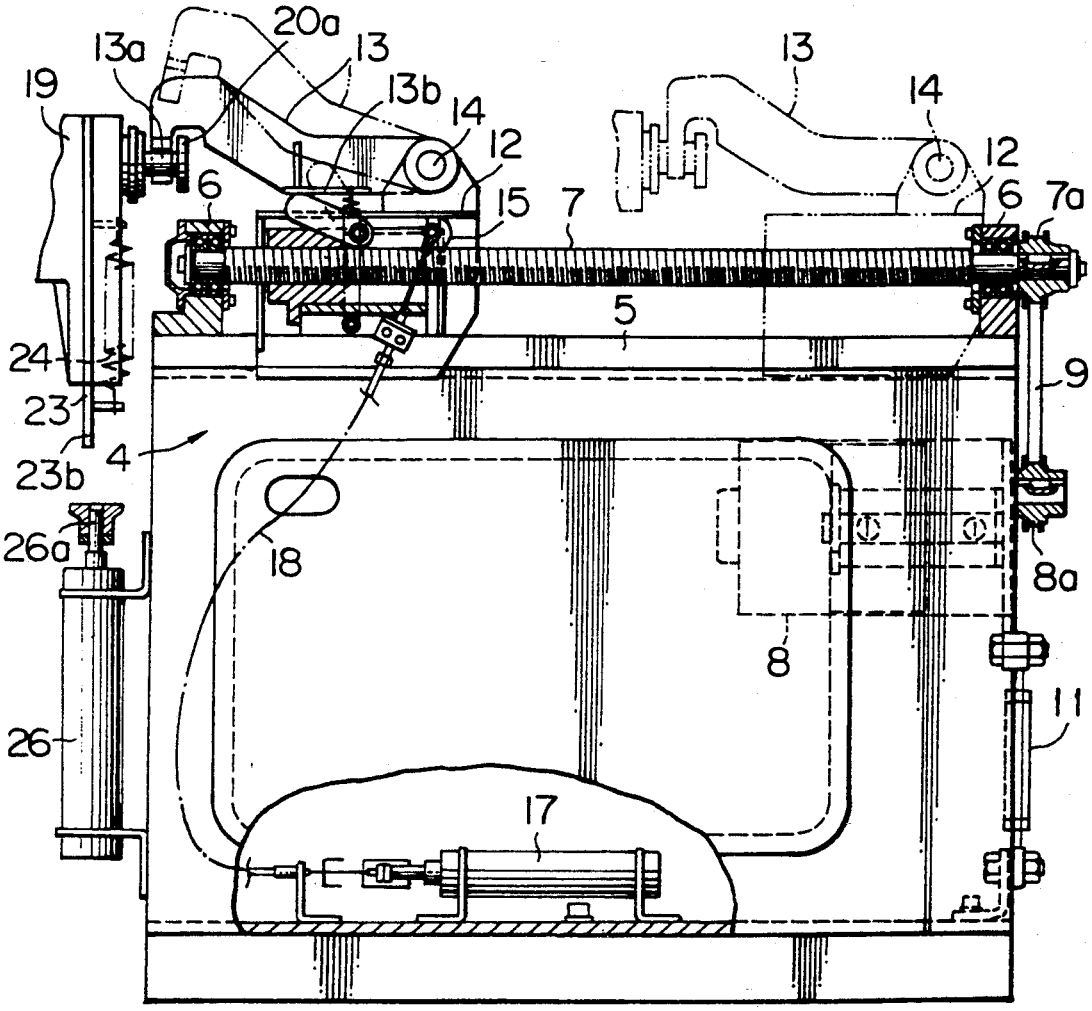
FIG. 4 is a side view illustrating one side of a stand frame.
Figure 5:
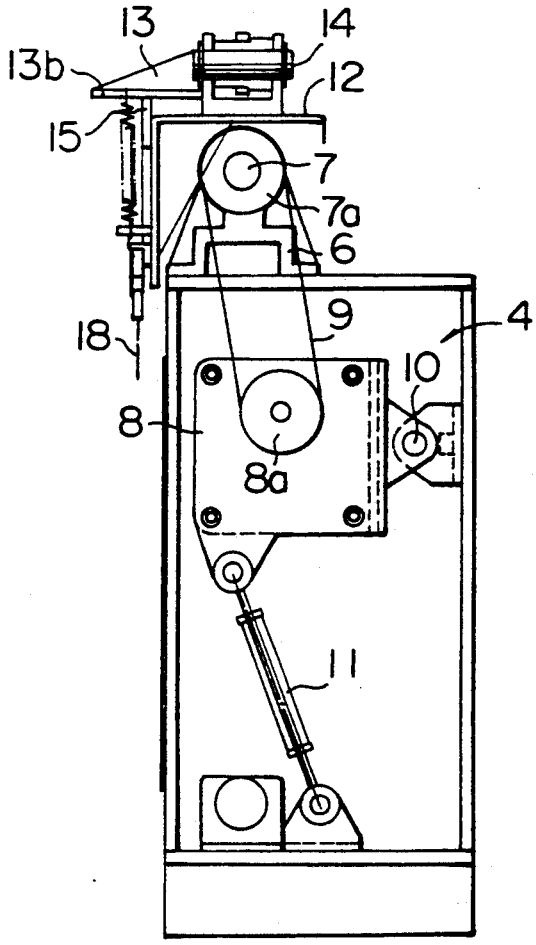
FIG. 5 is a right-side view thereof.

Referring particularly to FIGS. 2 and 3, the knitted fabric winding device H will be described in detail hereinafter. A pair of stand frames 4 are disposed in opposing relationship with each other below the needle cylinder c, and a guide rail 5 is mounted on the upper surface of each stand frame 4 so as to extend horizontally in alignment with each other. As best shown in FIG. 4, adjacent to the ends in the longitudinal direction of the guide rail 5 are provided bearings 6, respectively, and the both ends of a lead screw 7 are supported by these bearings 6 in such a way that the lead screw 7 extends in parallel with the guide rail 5. Furthermore, as best shown in FIG. 5, a pulley 7*a* is securely attached to one end of the lead screw 7 and is directly coupled to the output shaft 8*a* of a drive motor 8, such as a stepper motor, through a power transmission belt 9 such as a timing belt. The drive motor 8 is pivoted with a pivot pin 10 to the side wall of each stand frame 4 in such a way that it can adjust the tension of the transmission belt 9 by means of an adjusting screw rod 11.

Figure 6:
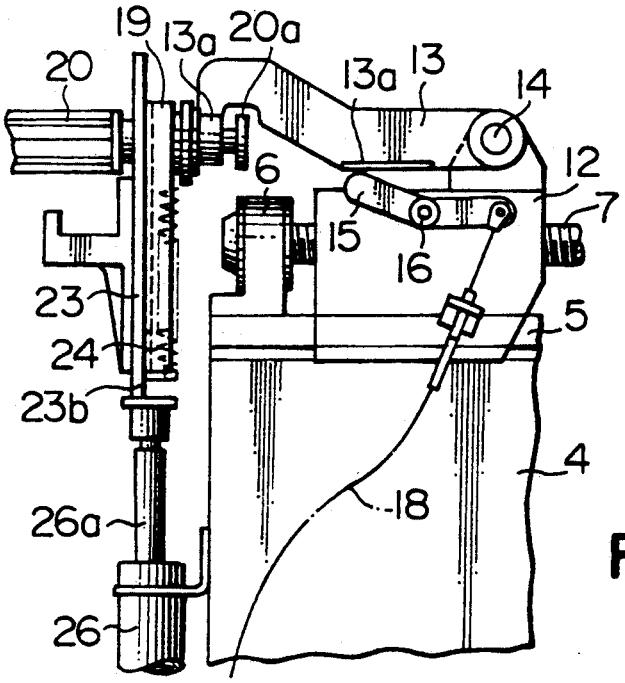
FIG. 6 is an enlarged fragmentary view to explain the operation of some machine components shown in FIG. 4.

A slider 12 is threadedly mounted on the lead screw 7 in such a way that it is guided by the guide rail 5 to move in the axial direction. One end of an engaging arm 13 is vertically swingably pivoted by means of a pivot pin 14 to the upper surface of the slider 12. Furthermore, as best shown in FIG. 6, the other end of the engaging arm 13 is in the form of a bifurcated engaging portion 13*a* adapted to engage with a flange 20*a* of each of takeup shafts 20 to be described hereinafter. A rocker lever 15 is swingably pivoted with a pivot pin 16 to the slider 12 adjacent to the engaging arm 13 in such a way that one end of the rocker lever 15 can push an engaging lug 13*b* extended integrally from the engaging arm 13. The other end of the rocker lever 15 is connected through a transmission cable 18 to an actuator 17 (FIG. 4) such as an air cylinder mounted on a base of the stand frame 4.

Referring back to FIGS. 2 and 3, the takeup shafts 20 which, for instance, are splined, are supported in parallel with the lead screw 7 between the pair of supporting members 19 depending from said rotary member in the machine stand 3 in such a way that each splined takeup shaft 20 can slide in the axial direction and rotates intermittently by a ratchet mechanism (not shown).

Figure 7:
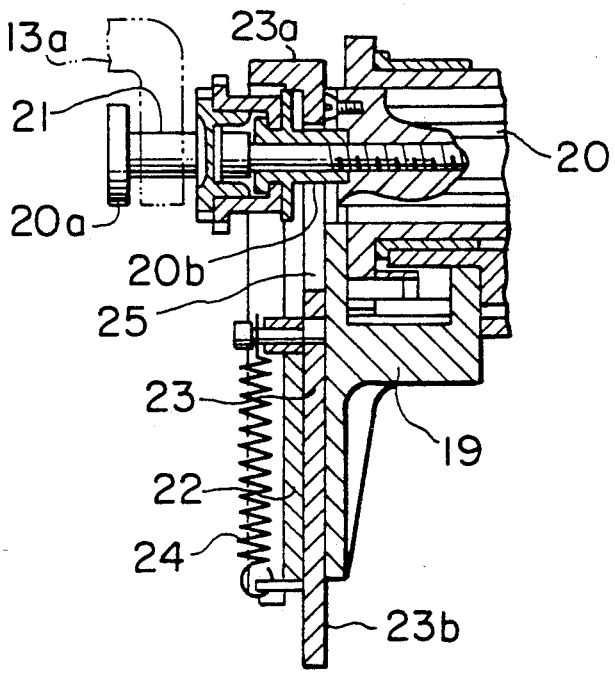
FIG. 7 is a sectional view of a portion of a takeup shaft incorporated in the knitted fabric winding apparatus.
Figure 8:
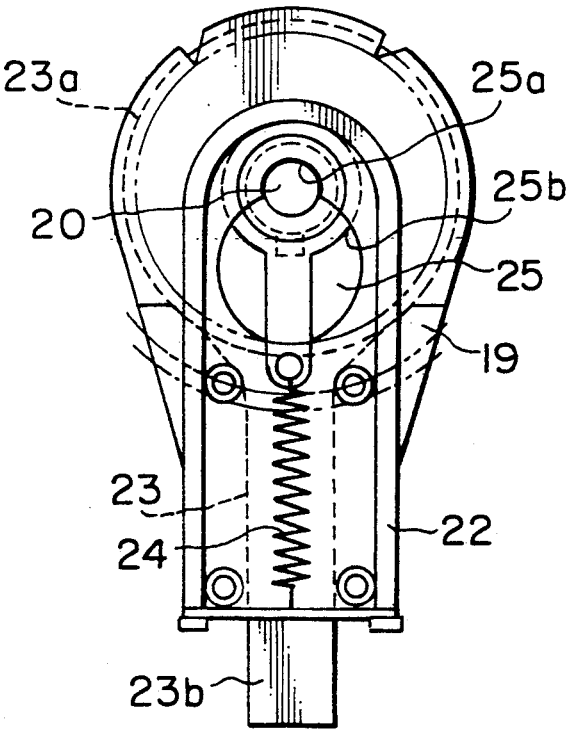
FIG. 8 is a left-side view thereof.

Referring next to FIGS. 7 and 8, the flange 20*a* at one end of each takeup shaft 20 is so formed as to define a circular groove 21 and, as described above, the bifurcated engaging portion 13*a* of the engaging arm 13 engages with and disengages from the flange 20*a*. A cover 22 is attached over the outer surface of each supporting member 19 and is spaced apart by a suitable distance therefrom so as to define a space between them. A lock member 23 is vertically slidably fitted into this space and is biased by a coiled spring 24 so that the upper end of the lock member 23 can engage with a peripheral groove 20*b* of the takeup shaft 20.

More specifically, an engaging hole 25 made up of continuously formed small- and large-diameter holes 25*a* and 25*b* is formed in the top portion 23*b* of the lock member 23, and the peripheral groove 20*b* of the takeup shaft 20 engages with the small-diameter hole 25*a* of the engaging hole 25 under the force of the coiled spring 24. As best shown in FIG. 4, an actuator 26 such as an air cylinder is vertically mounted on the vertical side wall of the stand frame 4 below the lock member 23. The output shaft 26*a* of the actuator 26 is adapted to upwardly push the lower end 23*b* of the lock member 23 against the force of the coiled spring 24, thereby disengaging the small-diameter hole 25*a* of the engaging hole 25 from the peripheral groove 20*b* of the takeup shaft 20.

Figure 11:
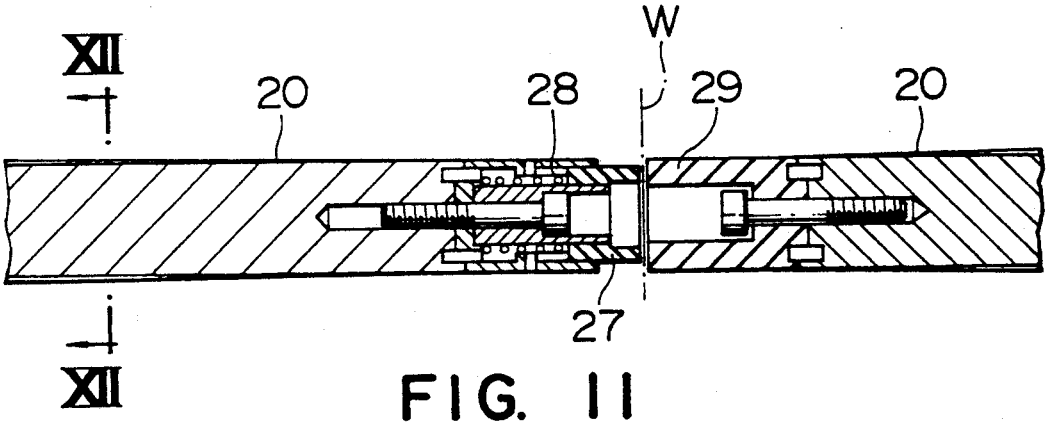
FIG. 11 is a sectional view, on an enlarged scale, of the knitted fabric gripping members of the takeup shafts.
Figure 12:
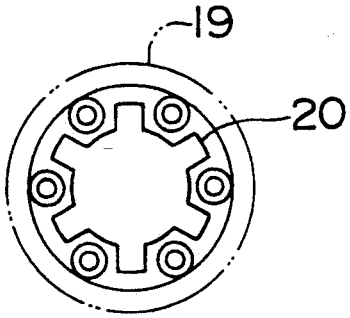
FIG. 12 is a sectional view taken along the chain line XII—XII of FIG. 11.
Figure 14:
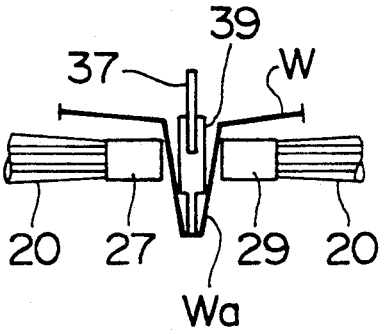
FIG. 14 is a top view, on an enlarged scale, for explaining the mode of operation of free end portions of the takeup shafts.

Referring to FIGS. 11 and 12, a movable abutting member 27 made of an elastomer such as a synthetic resin or rubber is attached to the free end of one takeup shaft 20 in such a way that it projects outwardly under the force of a coiled bias spring 28. An elastic member 29 made of a synthetic resin or rubber is attached to the free end of the other takeup shaft 20 in opposing relationship with the free end of the one takeup shaft 20 for engagement with the movable abutting member 27. Therefore, as shown in FIG. 14, the movable abutting member 27 and the elastic member 29 cooperate to clamp an end portion of the knitted fabric W as will be described in more detail hereinafter.

Figure 13:
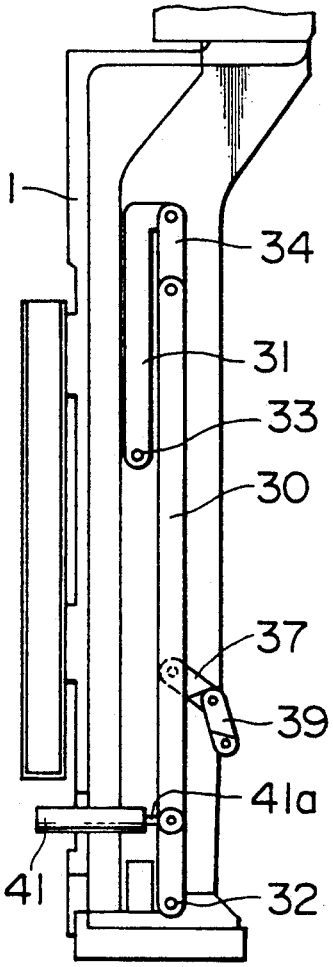
FIG. 13 is a view illustrating a knitted-fabric insertion link mechanism of the knitted fabric takeup apparatus.
Figure 15:
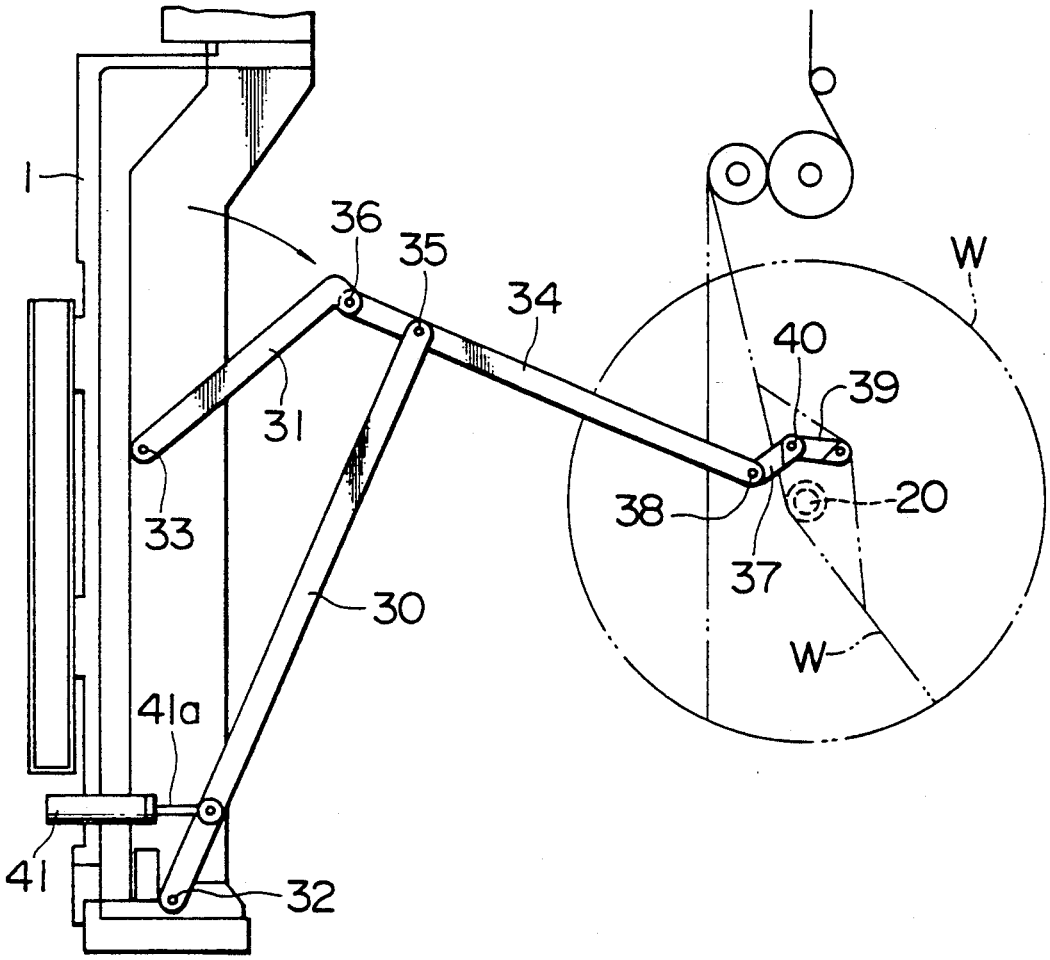
FIG. 15 illustrates an expanded state of the knitted fabric insertion link mechanism.
Figure 16:
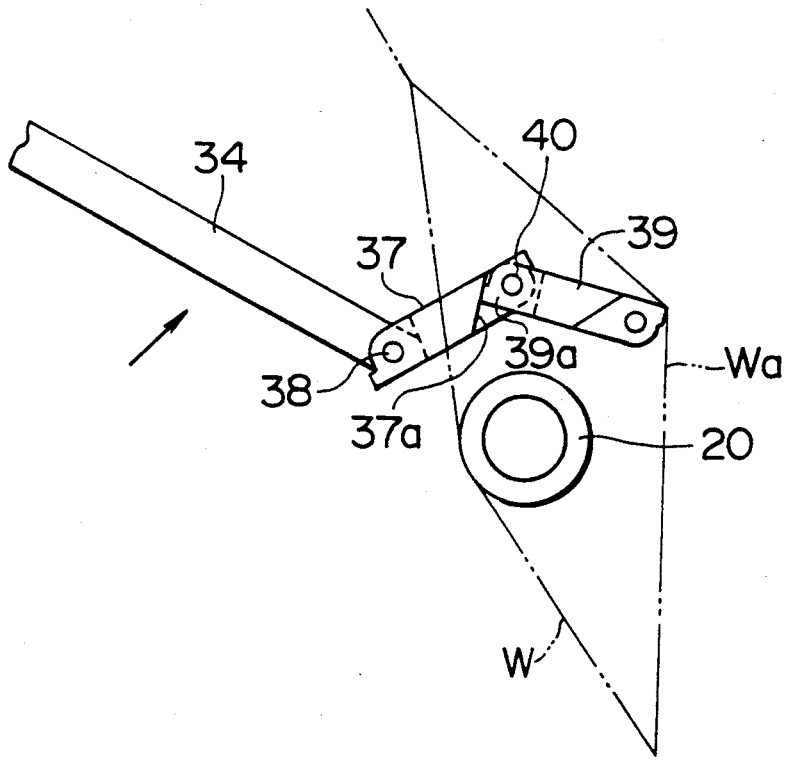
FIG. 16 is a side view, on an enlarged scale, for explaining the mode of operation of the insertion link mechanism.
Figure 18:
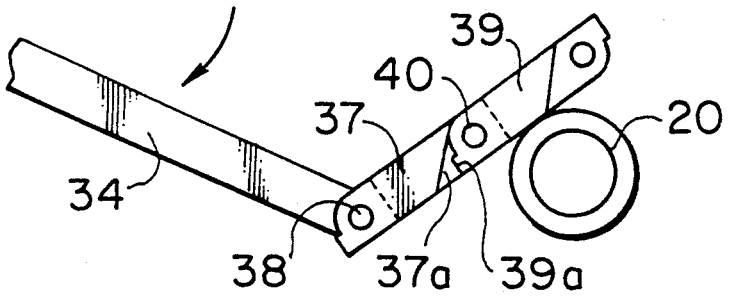
FIG. 18 is a view for explaining the operation of the free end portion of the insertion link mechanism.
Figure 19:
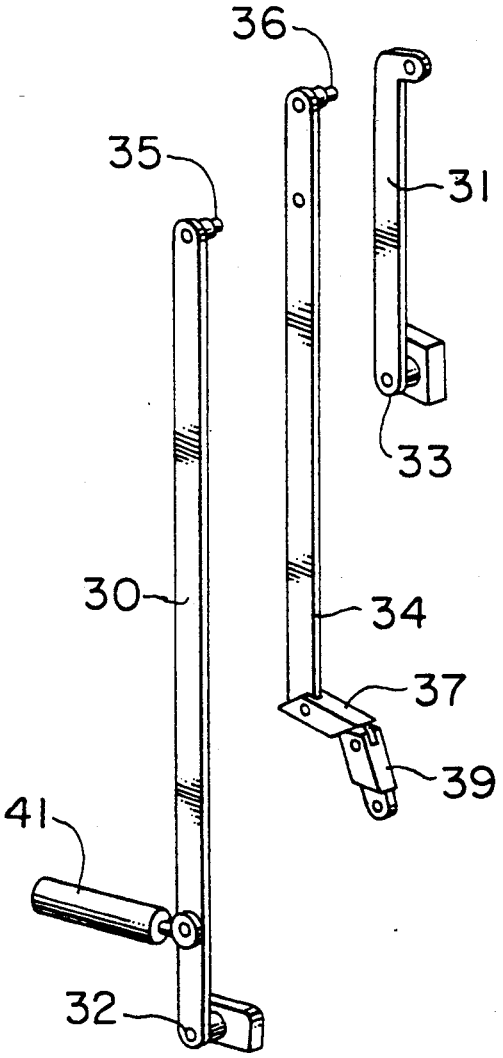
FIG. 19 is an exploded perspective view of the insertion link mechanism.

As shown in FIGS. 2, 13 and 15, along a vertical side of one leg 1 and adjacent to the position at which the free ends of the takeup shafts 20 engage with each other, a first longer lever 30 and a second shorter lever 31 are pivoted at the lower ends thereof to the leg 1 with pivot pins 32 and 33, respectively. The upper end of the second lever 31 is connected with a pin 36 to one end of a third lever 34 while the upper end of the first lever 30 is also connected with a pin 35 to the third lever 34 at a point spaced apart by a predetermined distance from the pin 36 toward the other end of the third lever 34 which in turn is pivoted with a pivot pin 38 to one end of a supporting lever 37. The other end of the supporting lever 37 is pivoted with a pivot pin 40 to one end of a fabric thrust arm 39 which serves to thrust and insert a portion of the knitted fabric W between the takeup shafts 20 as will be described in more detail hereinafter. As best shown in FIGS. 16 and 18, the fabric thrust arm 39 has an abutment portion 39*a* adapted to abut against a shoulder 37*a* of the supporting lever 37 by its own weight. The fabric thrust arm 39 is permitted to rotate in a counterclockwise direction as viewed in FIG. 16 only during a return as will be described later. As shown in FIG. 15, an actuator 41 such as an air cylinder is mounted horizontally on the leg 1 and its output shaft 41*a* is connected to the first lever 30 at a position spaced apart by a predetermined distance from the lower end toward the upper end thereof. The levers 30, 31, 34 and 37 constitute a knitted fabric insertion mechanism.

Figure 17:
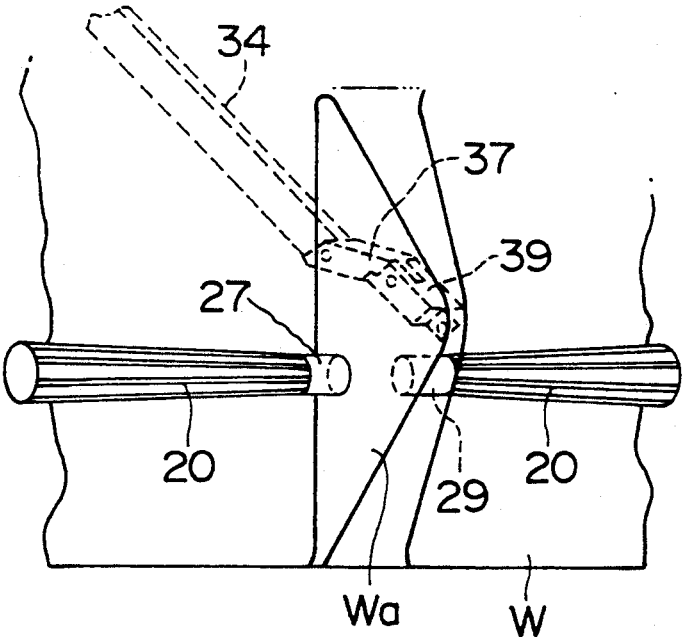
FIG. 17 is a perspective view for explaining the same operation thereof.

An end portion of the knitted fabric W which has been knitted and is hanging is clamped between the movable abutting member 27 of one takeup shaft 20 and the elastic member 29 of the other takeup shaft 20 in a manner to be described below. When the output shaft 41*a* of the actuator 41 is extended, the first and second levers 30 and 31, which are drivingly connected to the output shaft 41*a* are forced to rotate about the pins 32 and 33, respectively, in a clockwise direction in FIG. 15 so that the supporting lever 37 and the web thrust arm 39 on the third lever 34 are forcibly displaced to the right in FIG. 15. As a result, the fabric thrust arm 39 together with an end portion of the knitted fabric W is forced to be inserted between the abutment member 27 and the elastic member 29 of the takeup shafts 20 so that as shown in FIG. 17, a portion Wa of the lower end portion of the knitted fabric W is projected, assuming a form of a triangle. In this manner, the triangular portion Wa of the knitted fabric W is inserted between the abutment member 27 and the elastic member 29 and is frictionally clamped therebetween when the takeup shafts 20 move toward each other.

When the output shaft 41*a* of the actuator 41 is retracted, the first and second levers 30 and 31, which are drivingly connected to the output shaft 41*a*, are caused to rotate about their pins 32 and 33, respectively, to their initial positions shown in FIG. 13 so that the third lever 34 is also returned to its initial position. In this case, as shown in FIG. 18, only in the return stroke described above, the fabric thrust arm 39 is permitted to rotate in the counterclockwise direction as shown in FIG. 18 to clear the takeup shaft 20.

The mode of operation of the embodiment with the above-described construction will now be described below.

Both of the stand frames 4 are the same in construction and in the mode of operation and therefore a description of one will suffice for both.

When the knitted fabric W is to be wound or rolled, the actuator 17 shown in FIG. 4 is energized whereby the transmission cable 18 pushes the rocker lever 15 to permit downward movement of the engaging arm 13 so that its engaging portion 13*a* engages with the flange 20*a* of each takeup shaft 20.

Figure 10:
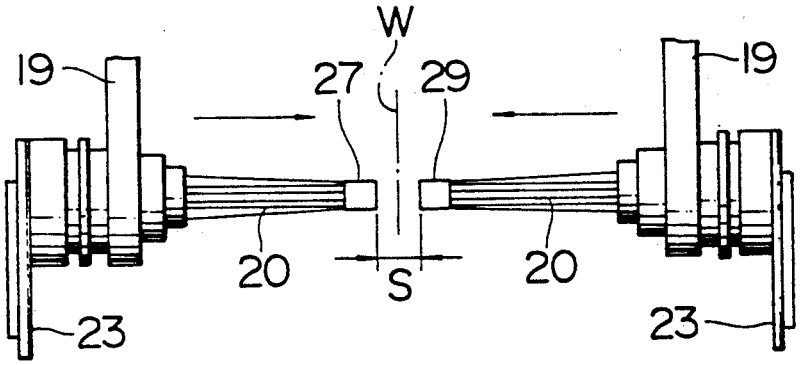
FIG. 10 is a fragmentary view of a portion of FIG. 9.

Then the drive motor 8 is energized to rotate the lead screw 7 through the transmission belt 9 so that the slider 12, which is threadedly carried by the lead screw 7, is displaced from the position indicated by the imaginary lines to the position indicated by the solid lines in FIG. 4. Then, as shown in FIG. 10, the free ends of the takeup shafts 20 move toward each other leaving a gap S therebetween and, as shown in FIGS. 14 through 17, the operation for clamping the lower end portion of the hanging knitted fabric W between the abutting member 27 of one takeup shaft 20 and the elastic member 19 of the other takeup shaft 20 is carried out.

More specifically, when the output shaft 41*a* of the actuator 41 is extended, the first and second levers 30 and 31, which are drivingly connected to the output shaft 41*a*, are caused to rotate about the pins 32 and 33, respectively, to the positions shown in FIG. 15 so that the third lever 34 together with a portion Wa of the knitted fabric W is inserted between the abutting member 27 and the elastic member 29 and the portion Wa is frictionally clamped between the members 27 and 29 by the clamping operation of the takeup shafts 20 as best shown in FIG. 17.

The output shaft 41*a* of the actuator 41 is then extracted to rotate the first and second levers 30 and 31 about the pins 32 and 33, respectively, in the counterclockwise direction so that the third lever 34 is returned to its initial or home position. In this case, as best shown in FIG. 18, the fabric thrust arm 39 is permitted to rotate only when the third lever 34 is returned to its initial position so that even when the fabric thrust arm 39 is brought into contact with the takeup shaft 20, it will not interfere with the return of the third lever 34 to its initial position.

Figure 9:
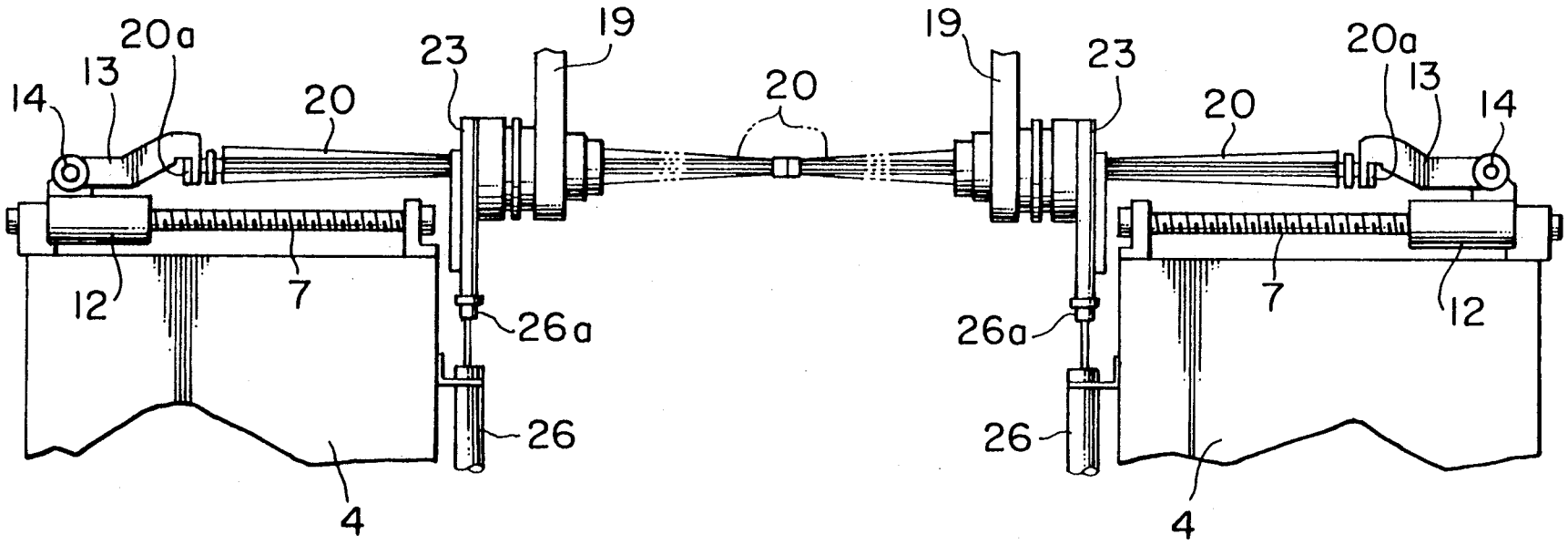
FIG. 9 is a side view to explain the mode of operation of the takeup shafts.

Thereafter, both of the sliders 12, which are threadedly mounted on the lead screws 7, respectively, are displaced inwardly so that both of the takeup shafts 20 are further moved inwardly through the engaging arms 13 on the sliders 12, and consequently the portion Wa of the knitted fabric W is firmly clamped between the abutting member 27 of one takeup shaft 20 and the elastic member of the other takeup shaft 20. And under the condition as shown in FIG. 9, the actuators 26 are deenergized to withdraw their output shafts 26*a* so that the lock members 23 are caused to move downwardly under the stored forces of the coiled springs 24 and then the edges of the small-diameter holes 25*a* of the engaging holes 25 of the lock members 23 engage with the takeup shafts 20, respectively, whereby the takeup shafts 20 are securely held and prevented from moving outwardly. Thus, the takeup shafts 20 can be securely held in position and prevented from moving outwardly.

As a knitted fabric W is produced, the takeup shafts 20 are rotated intermittently as is well known to those skilled in the art by a ratchet drive mechanism (not shown) so that the knitted fabric W is gradually wound around the takeup shafts 20 in the form of a roll.

When the knitted fabric W has been rolled up to a full size in the manner described above, the roll thus produced is removed from the takeup shafts 20. To this end the actuators 26 are energized to extend their output shafts 26*a* as shown in FIG. 6 so that the engaging holes 25 of the lock members 23 are disengaged from the takeup shafts 20 against the force of the coiled springs 24. Then, the takeup shafts 20 are permitted to move outwardly in the axial direction. More specifically, when the actuators 26 are energized, the lock members 23 are caused to move upwardly so that the engaging holes 25 are disengaged from the peripheral grooves 20*b* (FIG. 7), respectively, of the takeup shafts 20 whereby the shafts are unlocked. Thereafter, the lead screws 7 are reversed in rotation so that the sliders 12, which are threadedly mounted on the lead screws 7, are moved outwardly away from each other. Then the engaging arms 13 of the sliders 12 cause the takeup shafts 20 to outwardly move away from each other so that the roll of knitted fabric W can be released from the takeup shafts 20.

The knitted fabric winding device described above is advantageous in that it is simple in construction so that the operation as well as the inspection and maintenance can be much facilitated. In addition, the rolled knitted fabric W can be reliably pulled from the takeup shafts, and labor saving as well as improvement of the rolled knitted fabric W can be attained without wasting time and labor because an efficient mass production can be carried out. Furthermore, when the knitted fabric is rolled, it is prevented from being contaminated and damaged by the hands of an operator so that the quality of the knitted fabric can be improved.

After the knitted fabric W has been rolled up to a desired size or diameter, the knitted fabric W which has been rolled cannot be taken out unless it is cut from the fabric that follows it. Cutting the fabric is performed by a cutting device. The following is a description of the cutting device.

Figure 22:
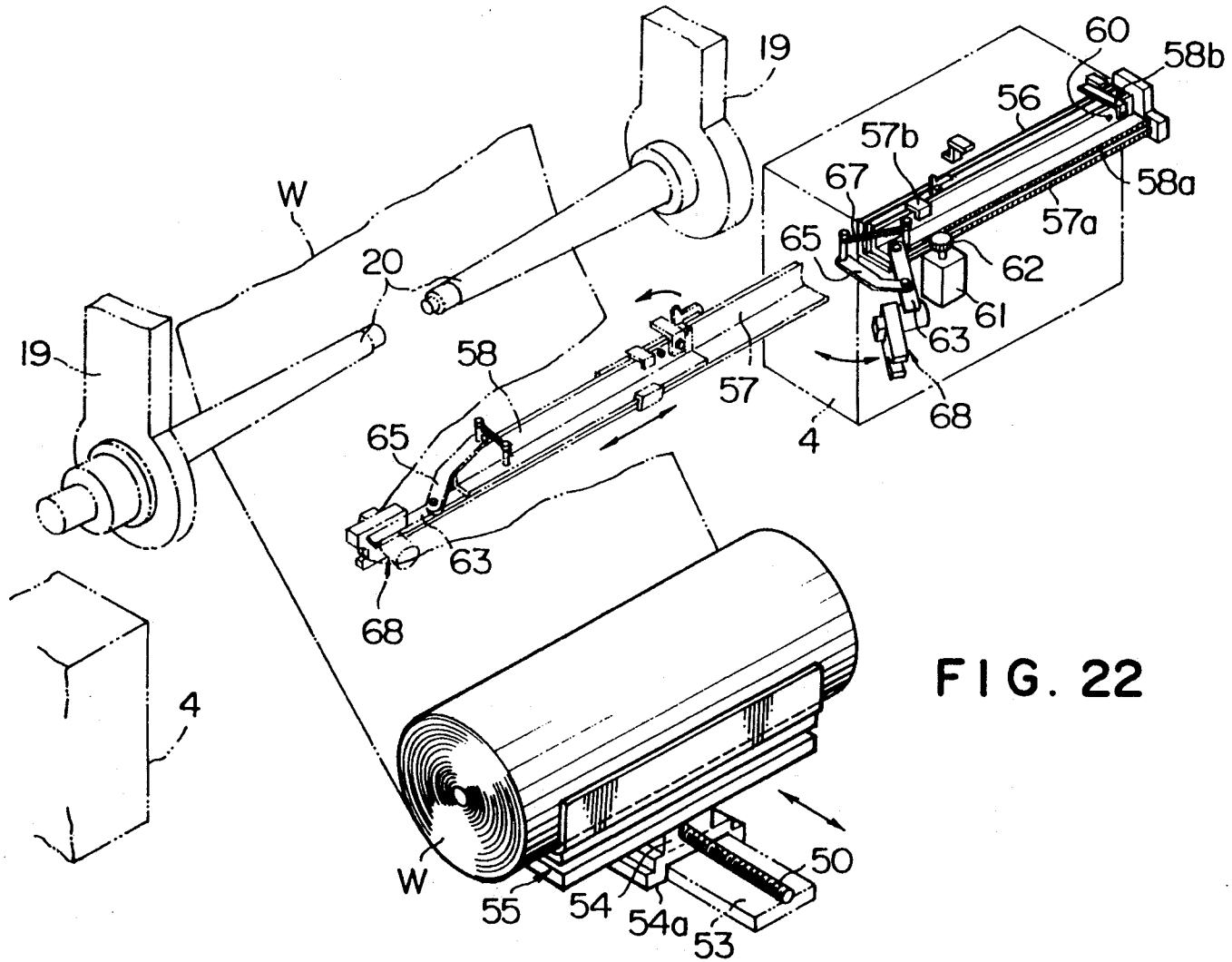
FIG. 22 is a perspective view of the fabric cutting mechanism of FIG. 20.

As shown in FIG. 2, a feed screw 50 is horizontally supported by a pair of bearings 49 which are mounted on a bottom base 1*a* fixedly secured to the legs described above. The feed screw 50 extends so as to be perpendicular with respect to the takeup shaft 20 described above. To an end portion of the feed screw 50 a motor 51 such as a stepper motor, is linked via a coupling 52. On the base 1*a* below the feed screw 50 is provided a guide rail 53 parallel to the feed screw 50. As shown in FIGS. 2 and 22, a slider 54 that also acts as a guide is screwed to the feed screw 50, and the leg portions 54*a* of this slider 54 engage with a guide rail 53 so as to be freely movable. On this slider 54 is provided a lifter device 55 which is movable vertically to receive a roll of the knitted fabric W.

Figure 23:
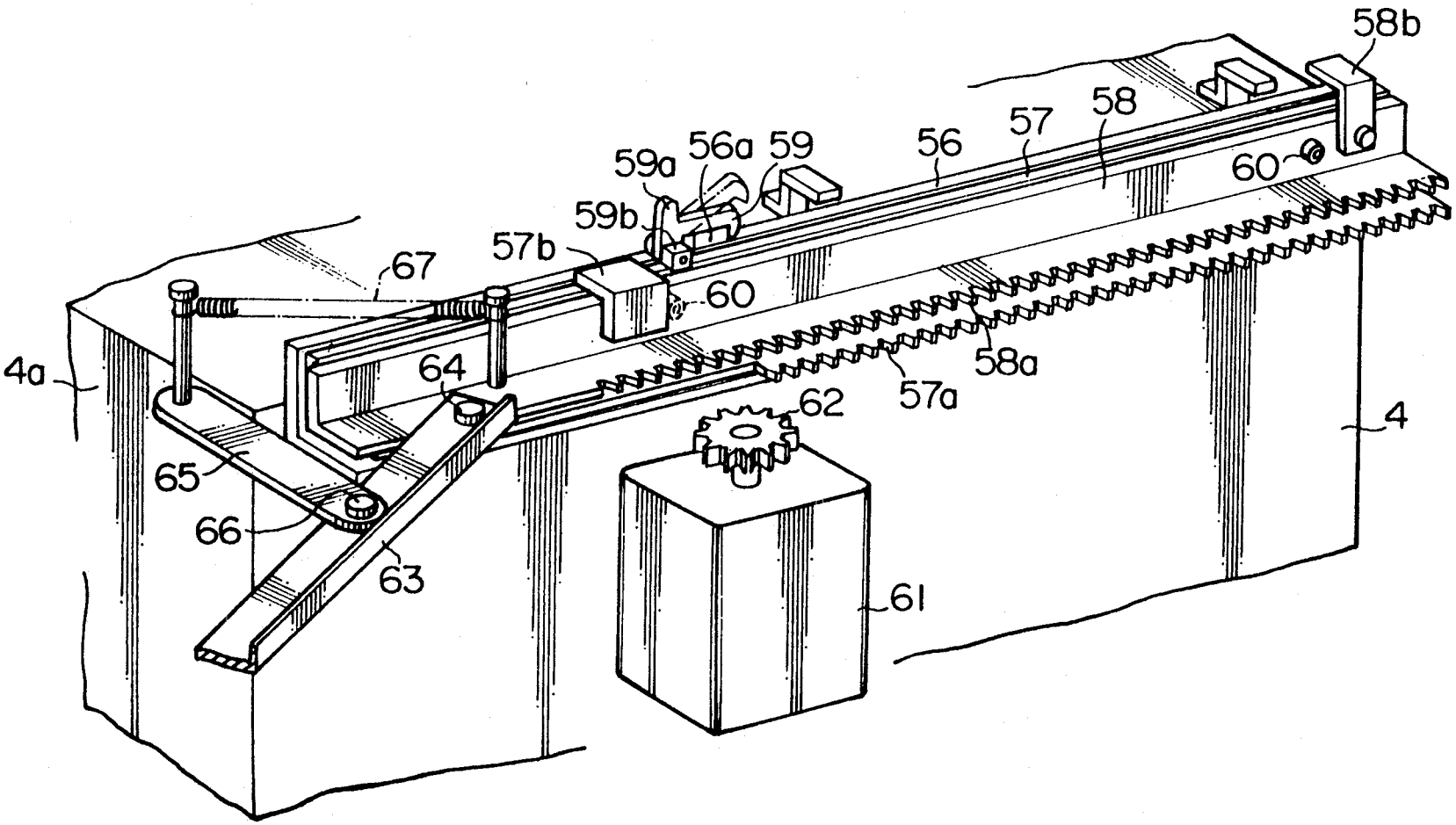
FIG. 23 is an enlarged perspective view showing major portions of the fabric cutting mechanism.

As best shown in FIG. 23, along the full length of the side wall of the upper portion of one of the stand frames 4 is horizontally fixed a guide rail 56 having an angle shape in cross section, and the horizontal web portion of this guide rail 56 supports thereon a lower rack unit 57 that also has an angle shape in cross section and is freely slidable. In addition, this lower rack unit 57 supports thereon an upper rack unit 58 that also has an angle shape in cross section. The upper side unit 58 is also slidable so as not to separate from the lower rack unit 57. To the top surface at about the center of the guide rail 56 is provided a protruding stopper 56*a*, and to the top surface at about the center of the lower rack unit 57 in the vicinity of the stopper 56*a* is provided a stop finger 59 which is pivoted by a pin 59*b* and engages with the stopper 56*a*. The stop finger 59 is formed so that a protrusion 59*a* extends in the upward direction. Furthermore, to the lower rack unit 57 in the vicinity of the stop finger 59 is fixedly provided an abutment member 57*b* which has an angle shape so as to slidably hold the vertical web of the upper rack unit 58. To a tail end portion (the right end portion as seen in FIG. 23) of the upper rack unit 58 is fixed a releasing member 58*b* that has an angle shape. A stop pin 60 protrudes transversely so that it can contact the abutment member 57*b*.

Figure 20:
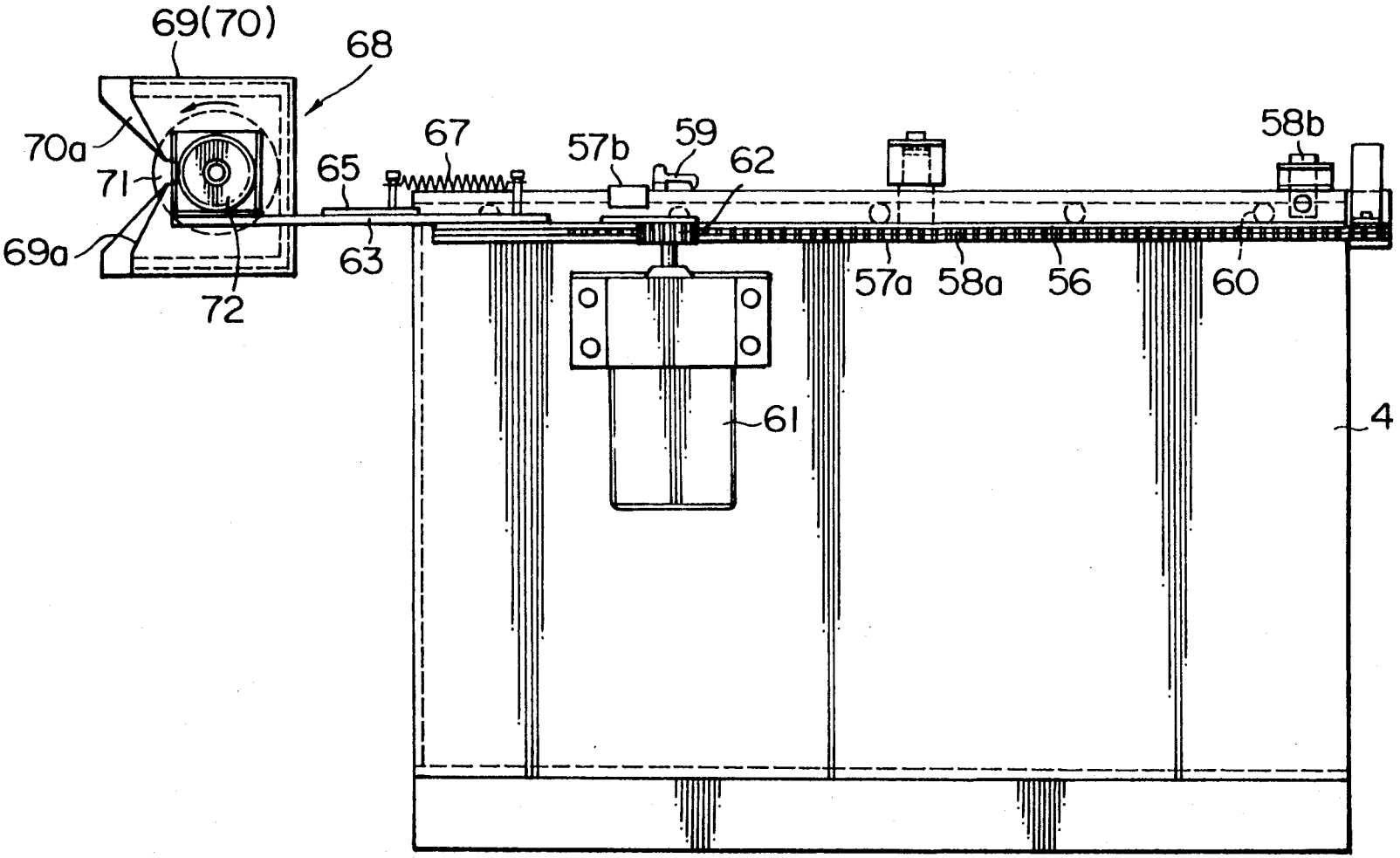
FIG. 20 is an elevational view of a fabric cutting mechanism.
Figure 21:
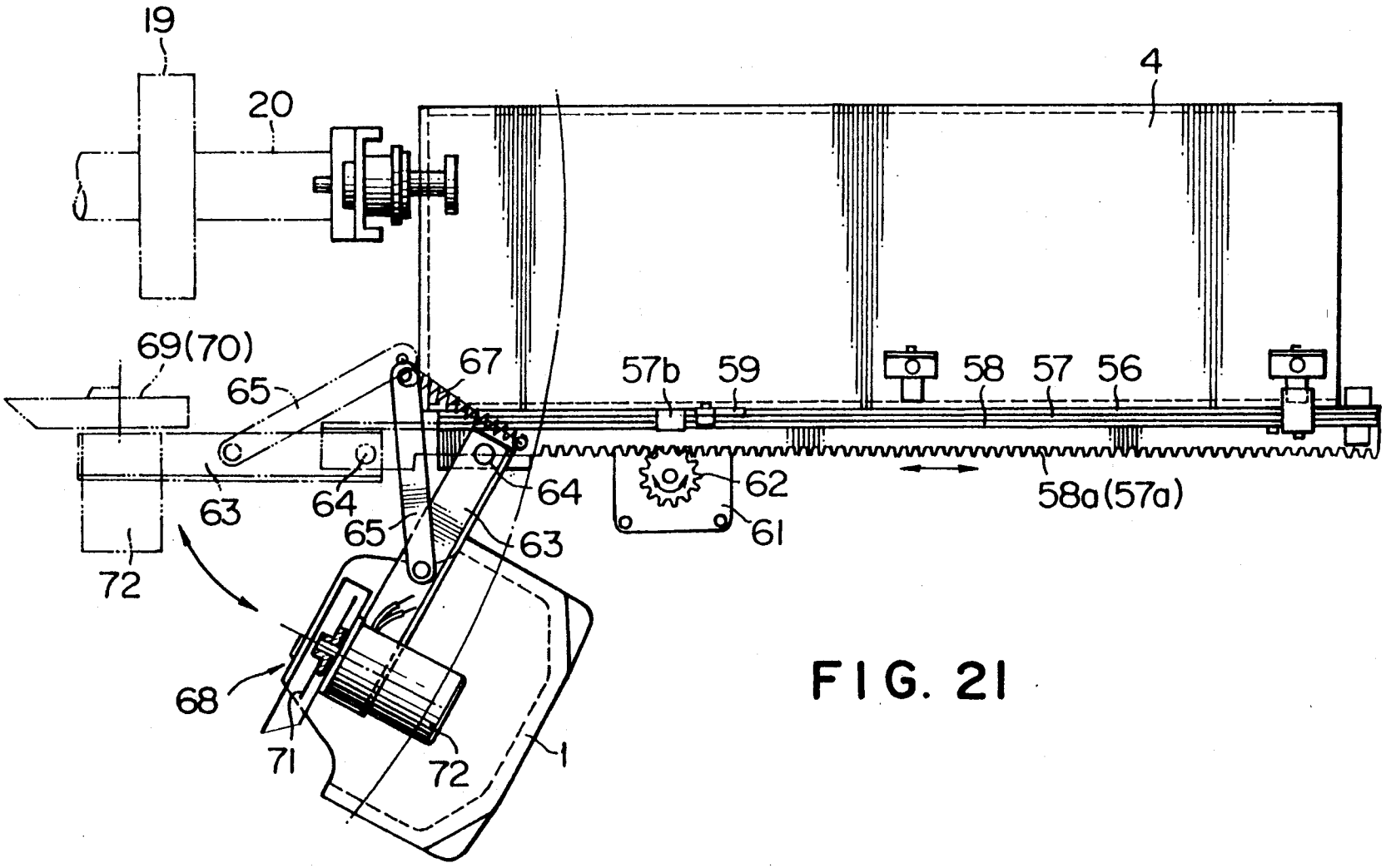
FIG. 21 is a plan view of the fabric cutting mechanism shown in FIG. 20.

As shown in FIG. 23, to the side wall of the upper portion of the stand frame 4 is mounted a drive motor 61 such as a stepper motor for example, and the output shaft of this drive motor 61 supports a pinion 62 which engages the rack 58*a* of the upper rack unit 58 and then engages the rack 57*a* of the lower rack unit 57, as described later. As shown in FIG. 20, the width of the pinion 62 in the direction of the shaft is a width that can engage both racks 58*a*, 57*a*. The rack 57*a* terminates in the vicinity of the pinion 62, as shown in FIG. 23. To the forward portion of the upper rack unit 58 is pivotably supported a support lever 63 so as to be swingable about a pin 64. A pulling arm 65 is pivoted by a pin 66 on the support lever 63 in the vicinity of the pin 64. The pulling arm 65 is urged by a coiled spring 67 so that the arm 65 comes into contact with an inner side surface 4*a* of the stand frame. As shown in FIG. 22, when the knitted fabric W is to be cut, the upper rack unit 58 advances to the left as shown by the chain line in the figure, and the pulling arm 65 is urged by the coil spring 67 so that the support lever 63 rotates in the clockwise direction as viewed in FIG. 21 so as to take an orientation along the vertical web portion of the upper rack unit 58, whereby the support lever 63 is brought in line with the length of the upper rack unit 58. As shown in FIGS. 20, 21 and 22, to the free distal end portion of the support lever 63 is mounted a cutter unit 68.

Figure 24:
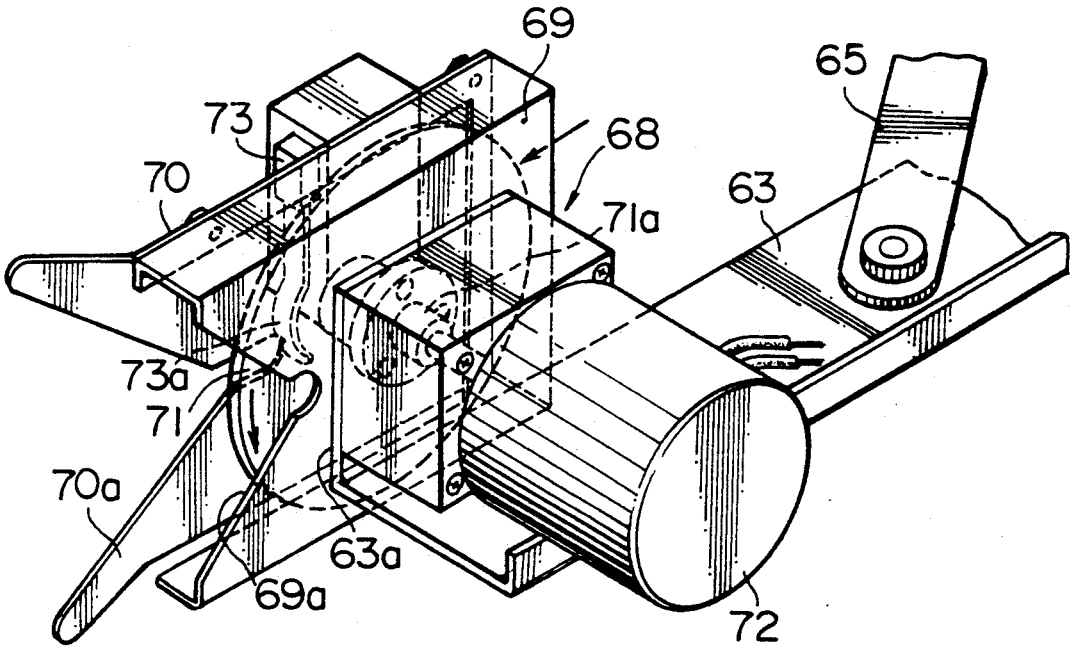
FIG. 24 is a perspective view showing a cutter unit of the fabric cutting mechanism.
Figure 25:
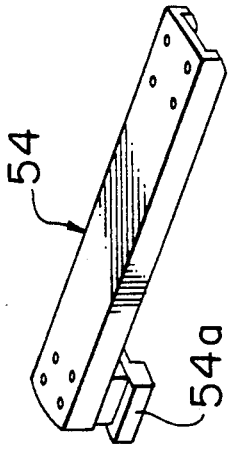
FIG. 25 is a perspective view of a slider.

As shown in FIG. 24, to a bracket 63*a* fixed to the free distal end portion of the support lever 63 is supported a pair of opposing fabric guide plates 69 and 70, and to the distal end opening portions of these fabric guide plates are formed fabric guide portions 69*a* and 70*a* that are cutout portions in the shape of a V, and that can guide the roll of the knitted fabric W. Between cutter 71 so as to be freely rotatable and so as to protrude into the fabric guide cutouts 69*a* and 70*a*. The disc cutter 71 is attached to an output shaft 71*a* of a motor 72 mounted on the bracket 63*a*. Furthermore, to the outer side of the fabric guide plate 70 is mounted a miscutting detection sensor 73 that has a detector 73*a*. The miscutting detection sensor 73 stops the operation of the motor 72 when it detects a miscut of the knitted fabric W. As shown in FIG. 21, when the cutter is not being used (that is, when it is stored), the cutter unit 68 is retracted into a recess of the leg 1 so that it does not interfere with other portions of the apparatus.

The following is a description of the operation of the cutting device.

When the knitted fabric W has been wound or rolled to a desired size on the takeup shaft 20, the lifter device 55 operates and raises the knitted fabric receiving platform and supports the roll of the knitted fabric W. Then, as has already been described, when each of the takeup shafts 20 is pulled outwards, the operation of the cutter unit 68 starts.

In FIGS. 22 and 23, first, when the drive motor 61 is operated, the pinion 62 of the drive motor 61 rotates whereby the upper rack unit 58 that engages with the pinion 62, moves toward the knitted fabric W. As a result, the pulling arm 65 is urged by the coil spring 67 so that arm comes into contact with the end surface of the guide rail 56. Because of this, as shown in FIG. 22, at the start of cutting of the knitted fabric W the upper rack unit 58 advances, and the pulling arm 65 is urged by the tensile force of the coil spring 67 so as to abut against the vertical web portion of the upper rack unit 58. When this occurs, the upper rack unit 58 continues to advance with the support lever 63 held in alignment with the length of the upper rack unit 58, and the rotating disc cutter 71 of the cutter unit 68 on the support lever 63 cuts across half of the width of the knitted fabric W.

In FIG. 23, the advancing of the upper rack unit 58 causes the releasing member 58*b* to press the protrusion 59*a* of the stop finger 59 and cancels the engagement with the stopper 56*a*. Simultaneously with this, the stop pin 60 of the upper rack unit 58 contacts the abutment members 57*b* of the lower rack unit 57. By this, the lower rack unit 57 begins to advance via the abutment member 57*b* and because of this, the pinion 62 engages with the rack 57*a* of the lower rack unit 57 so that the lower rack unit 57 also advances further toward the knitted fabric W, and the disc cutter 71 of the cutter unit 68 cuts the remaining half of the width of the knitted fabric W. After cutting, the reverse rotation of the pinion 62 reverses the motion of the lower rack unit 57 and the upper rack unit 58 so that they in effect fold over, and so that the cutter unit 68 is retracted into, and stored in the recess of the leg 1, where it does not interfere with the operation of other portions of the apparatus when it is not being used.

By the use of the cutting device as described above, it is possible to use a single disc cutter to cut the full width of the fabric and it is also possible to fold over the support mechanism of the disc cutter unit so that the cutter unit can be stored when it is not being used.

The following is a detailed description of the lifter device 55 that supports the roll of the knitted fabric W, as shown in FIG. 2.

Figure 26:
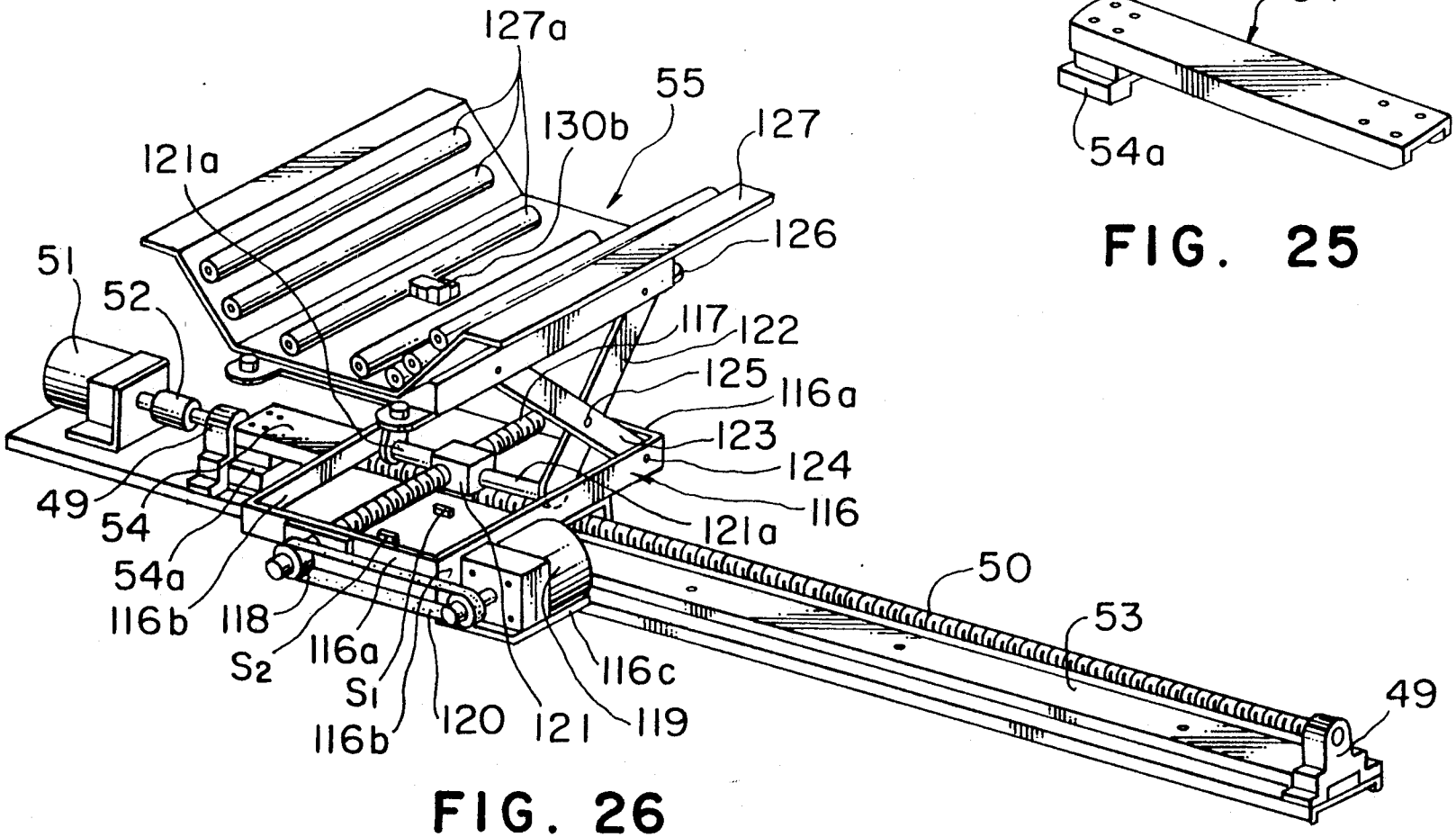
FIG. 26 is a perspective view showing a raised state of a fabric conveying device.
Figure 27:
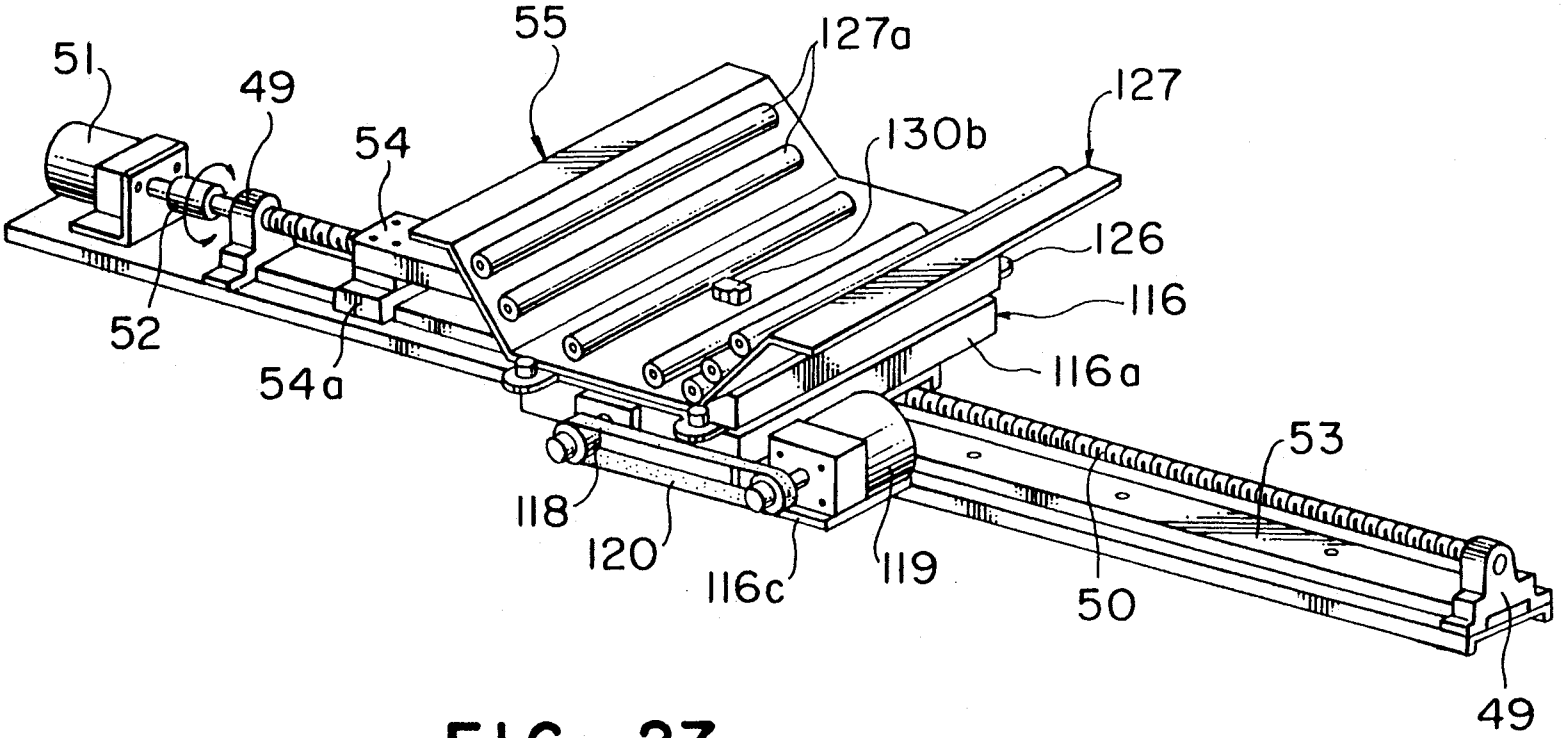
FIG. 27 is a perspective view showing a lowered state of the fabric conveying device.
Figure 28:
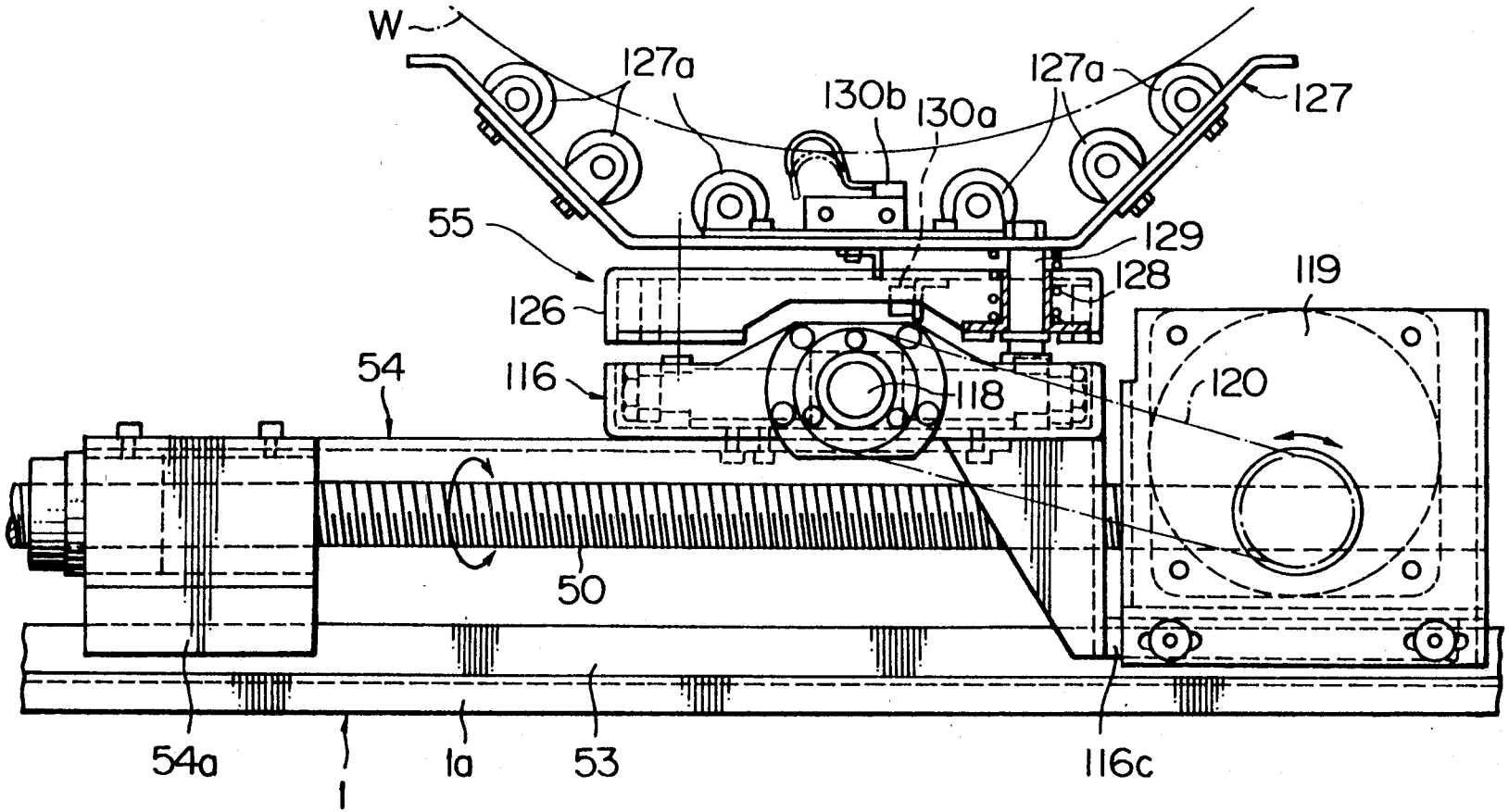
FIG. 28 is an enlarged elevational view showing major portions of the fabric conveying device.

In FIG. 26, the end portion of the slider 54 that is in screw engagement with the feed screw 50, horizontally supports a support frame 116 that has a square shape, and two sides of this support frame 116 each form a pair of guide plates 116*a* and 116*b*. Also, to each of the guide plates 116*a*, are horizontally screwed a lifting screw shaft 117 so as to extend perpendicular to the feed screw 50, and to a distal end portion of this screw shaft 117 is fixed a pulley 118. Furthermore, this pulley 118 is linked via a drive transmission belt 120 to a motor 119 such as a stepper motor. This motor 119 is supported by a bracket 116*c* on the support frame 116. A slider 121 is threaded to the screw shaft 117 and is horizontally provided with a pair of pressing rods 121*a* that are perpendicular with respect to the screw shaft 117, and to each of the distal end portions of these pressing rods 121*a* is pivoted the lower ends of each of the lifting struts 122. Also, the distal end portion of each of the guide plates 116*b* in the vicinity of the pressing rods 121*a* has a support pin 124 that pivots the lower end portion of another lifting strut 123. The lifting struts 122 and 123 intersect midway and the point of intersection is pivoted by means of a pin 125. Furthermore, on each of the upper distal ends of the lifting struts 122 and 123 is supported a fabric receiving platform 126, and as shown in FIG. 28, a receiving plate 127 of a substantially U-shape in cross section is mounted via a shock absorbing spring 128 and a support pin 129 to the fabric receiving platforms 126. Also, on the receiving plate 127 are provided a number of rollers 127*a* that are supported in parallel. Below the central portion of this receiving plate 127 is provided a knitted fabric detection sensor 130*a* such as a proximity switch that detects a full roll of the knitted fabric W when the roll is placed on the receiving plate 127. This knitted fabric detection sensor 130*a* operates to control the motor 119.

As shown in FIG. 26, in the running path of the slider 121 are provided detection switches $S_1$ and $S_2$ and these switches $S_1$ and $S_2$ detect the topmost position and the bottommost position of the lifting struts 122 and 123 of the lifter device 55, and each of these switches $S_1$ and $S_2$ controls the motor 119.

A fabric detection switch 130*b* is provided on the receiving plate 127, and when the knitted fabric W on the receiving plate 127 that has been moved away from the machine is removed, this switch 130*b* controls the operation of the motor 51 so that the receiving plate 127 returns to the initial position. The fabric detection switch 130*b* can be modified so that it can also be used as the fabric detection sensor 130*a*.

The following is a description of the lifter device 55.

Figure 29:
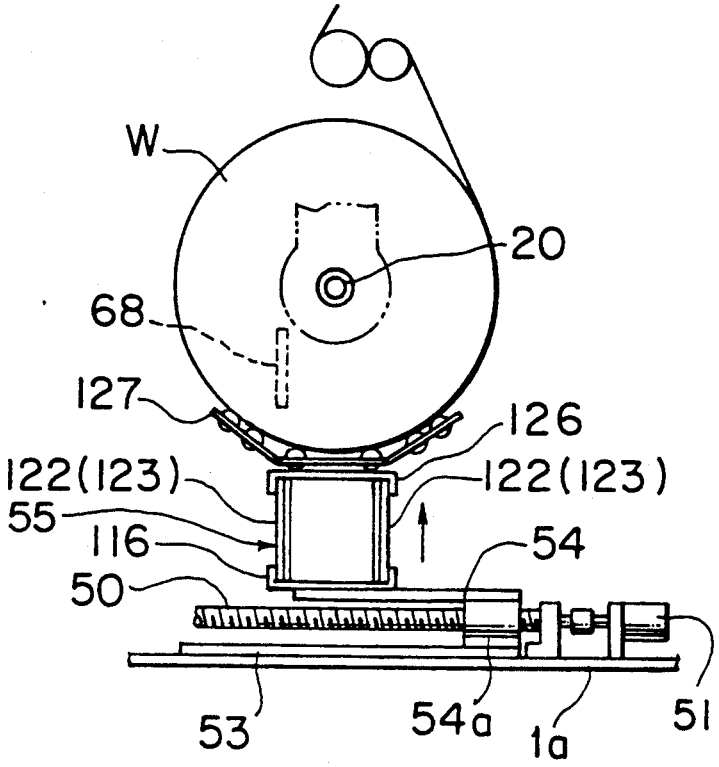
FIGS. 29 through 32 are views showing successive operational states of the fabric conveying device.

The motor 119 starts operation when the knitted fabric W has formed a full roll on the takeup shaft 20 in the state shown in FIG. 26. When this occurs, the motor 119 rotates the pulley 118 via the transmission belt 120 whereby the lifting screw shaft 117 moves the slider 121 threaded to it. Accordingly, the pressing rods 121*a* of this slider 121 rotate the lifting struts 122 and 123 about their centers of their pin 125 so that they become more upright, and the fabric receiving platform 126 and the receiving plate 127 are lifted to the upper limit as shown in FIG. 29. The operation of the motor 119 stops when the knitted fabric detection sensor 130*b* detects abutment with the roll of the knitted fabric W.

Figure 30:
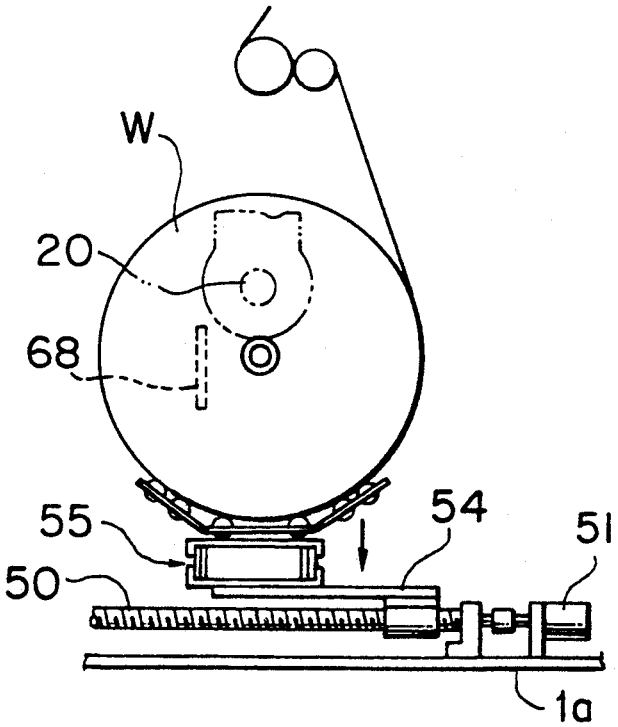

Then, the takeup shafts 20 are pulled outward from the machine in the manner already described. As a result, as shown in FIG. 29, the roll of the knitted fabric W is placed gently on the receiving plate 127 on the fabric receiving platform 126. When this occurs, the knitted fabric detection sensor 130*a* operates, and the motor 119 rotates in reverse so that the motor 119 rotates the pulley 118 in reverse direction via the transmission belt 120 whereby the lifting screw shaft 117 moves the slider 121 back to its original position. Then, the pressing rods 121*a* of the slider 121 move back with each of the lifting struts 122 so that the receiving plate 127 and the fabric receiving platform 126 that is supported by the lifting struts 122 and 123 are lowered to, and stopped at the lowest position as shown in FIG. 30.

The lifter device 55 moves up and down within a range of raising and lowering operation determined by the switches $S_1$ and $S_2$ that are acted upon by the slider 121.

Figure 31:
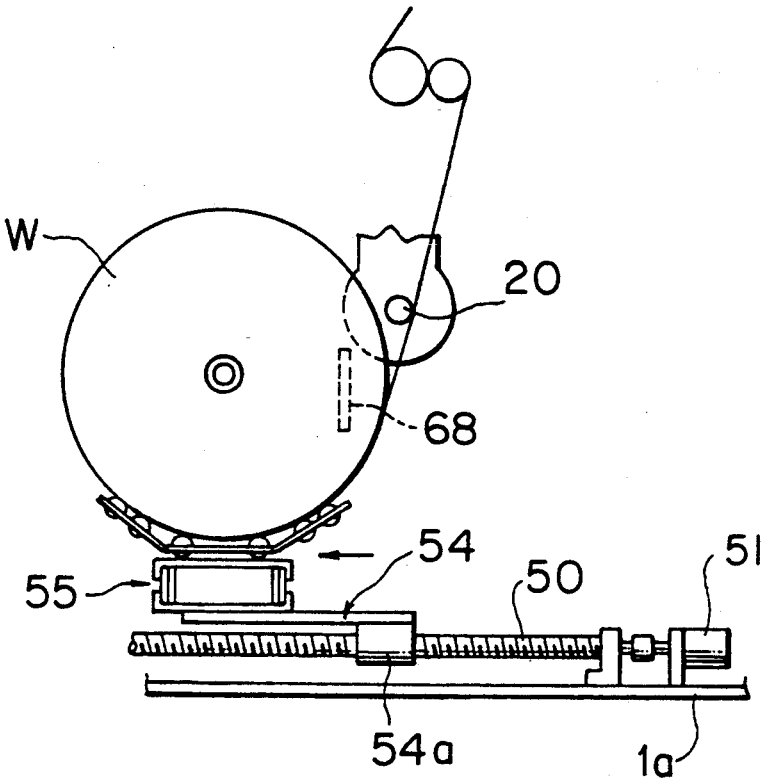
Figure 32:
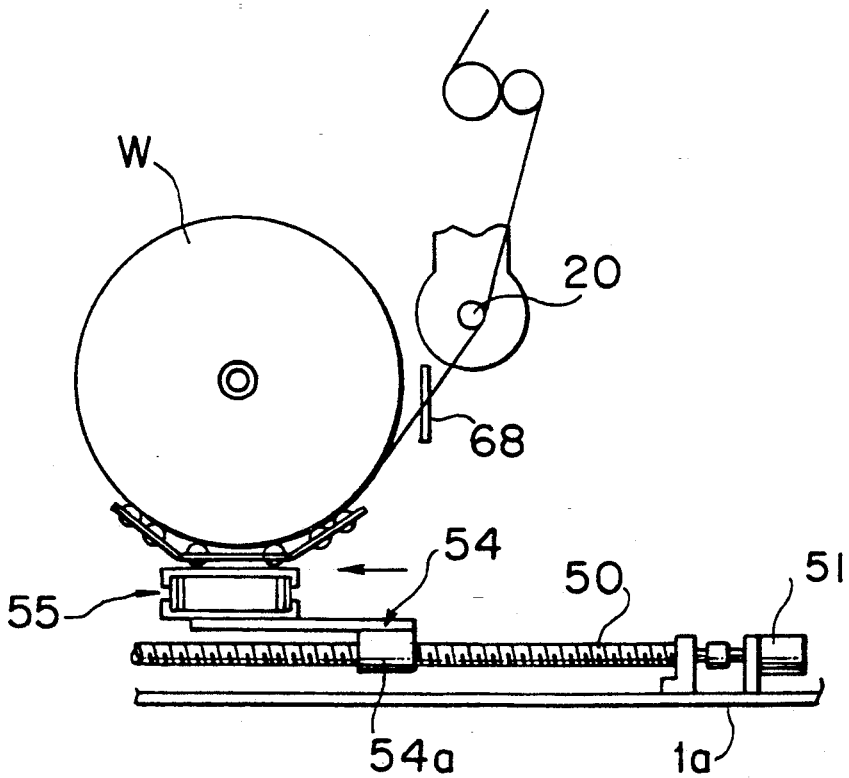

When the fabric receiving platform 126 has been lowered to, and stopped at the lowest position, the switch $S_2$ is operated so that the motor 51 operates. Because of this, the feed screw 50 that is coupled to the motor 51 rotates, and the lifter device 55 carrying the roll of knitted fabric W thereon together with the slider 54 is transported outward as shown in FIG. 31. Then, as shown in FIG. 32, the transportation stops after the position of the cutter unit 68 has been passed. When this occurs, the cutter unit 68 moves reciprocatingly as has been described, and after the knitted fabric W is cut, the roll of knitted fabric W is conveyed away from the machine to the next process, as shown by W' in FIG. 2.

Figure 33:
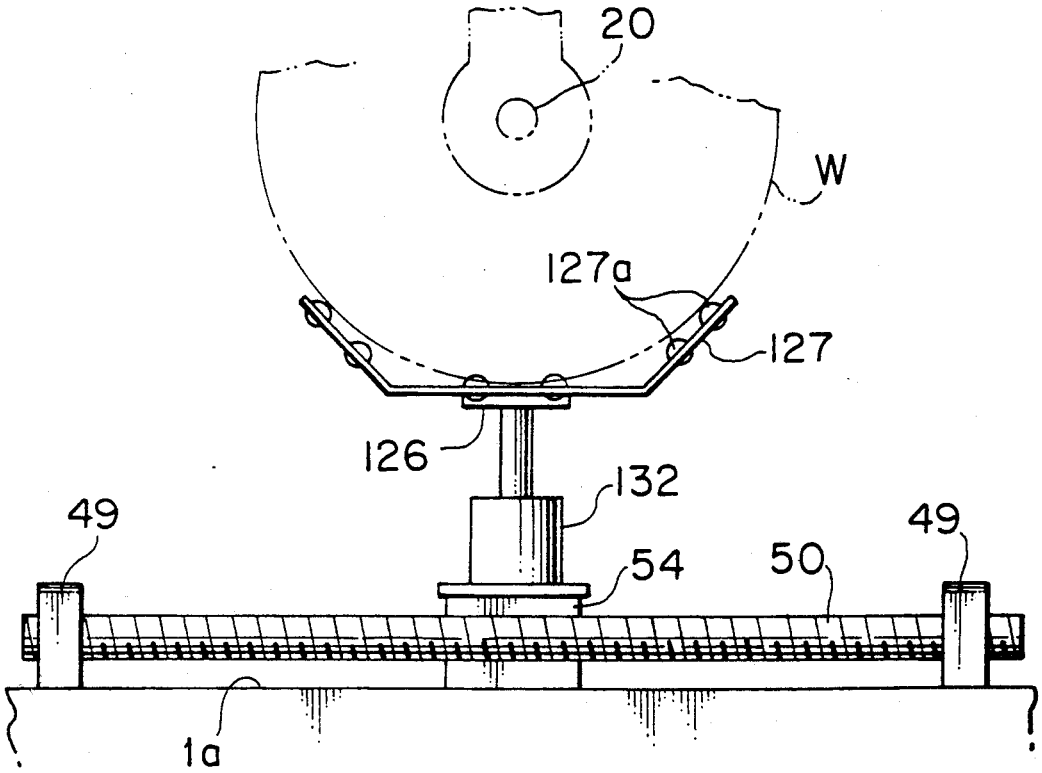
FIG. 33 is an elevational view showing a modification of the fabric conveying device.

FIG. 33 is a view of a modification. In this modification, a hydraulic or pneumatic cylinder device 132 is used instead of the pantograph mechanism of the lifter device 55 described above, and the fabric receiving platform 126 and the receiving plate 127 are mounted on the cylinder device 132 so that the configuration is simpler and inspection and maintenance are easier than the specific example described above.

The lifter device 55 described above was a specific example provided on the distal end portion of the slider 54, but it is also possible to have a design modification wherein a pair of lifter devices 55 are provided in a line to the front and rear of the slider 54 for example, so that each lifter device 55 operates alternately to receive each of the full rolls of knitted fabric W.

FIG. 34 through FIG. 41 are views showing a further modification where there are provided first and second lifter devices 55A and 55B having the same configuration as the lifter device 55 shown in FIG. 26. The configurations of the first and a second lifter devices 55A and 55B are the same so that those portions which correspond are indicated with corresponding reference numerals, and the corresponding descriptions of them are omitted. In this further modification, the first and a second lifter devices 55A and 55B are supported on a common slider 54, and a nut member 107 fixed to the bottom surface of this slider 54 is threaded to the feed screw 50 shown in FIGS. 35 and 36.

The following is a description of the operation of this further modification.

Figure 35:
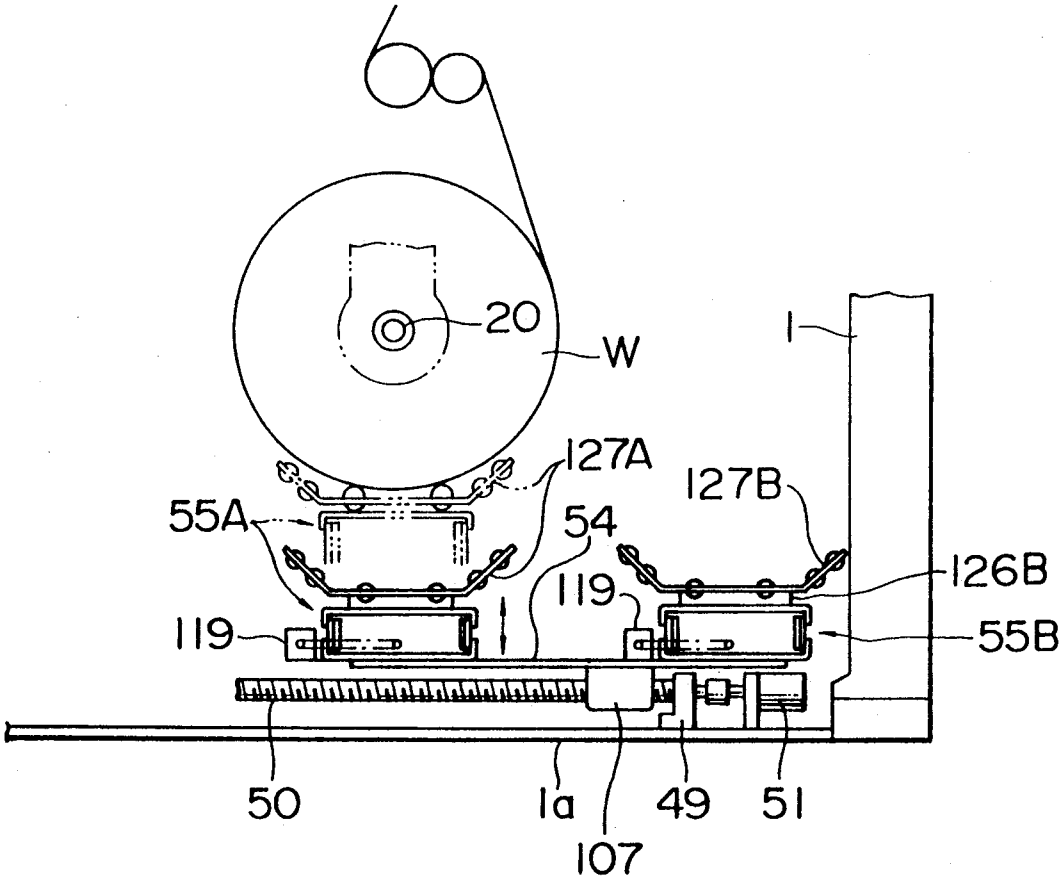
FIGS. 35, 36 and 37 are views showing successive different steps in the operation of the fabric conveying device shown in FIG. 34.

The operation of the first lifter device 55A starts as shown in FIG. 35 when the knitted fabric W has formed a full roll on the takeup shaft 20.

Figure 34:
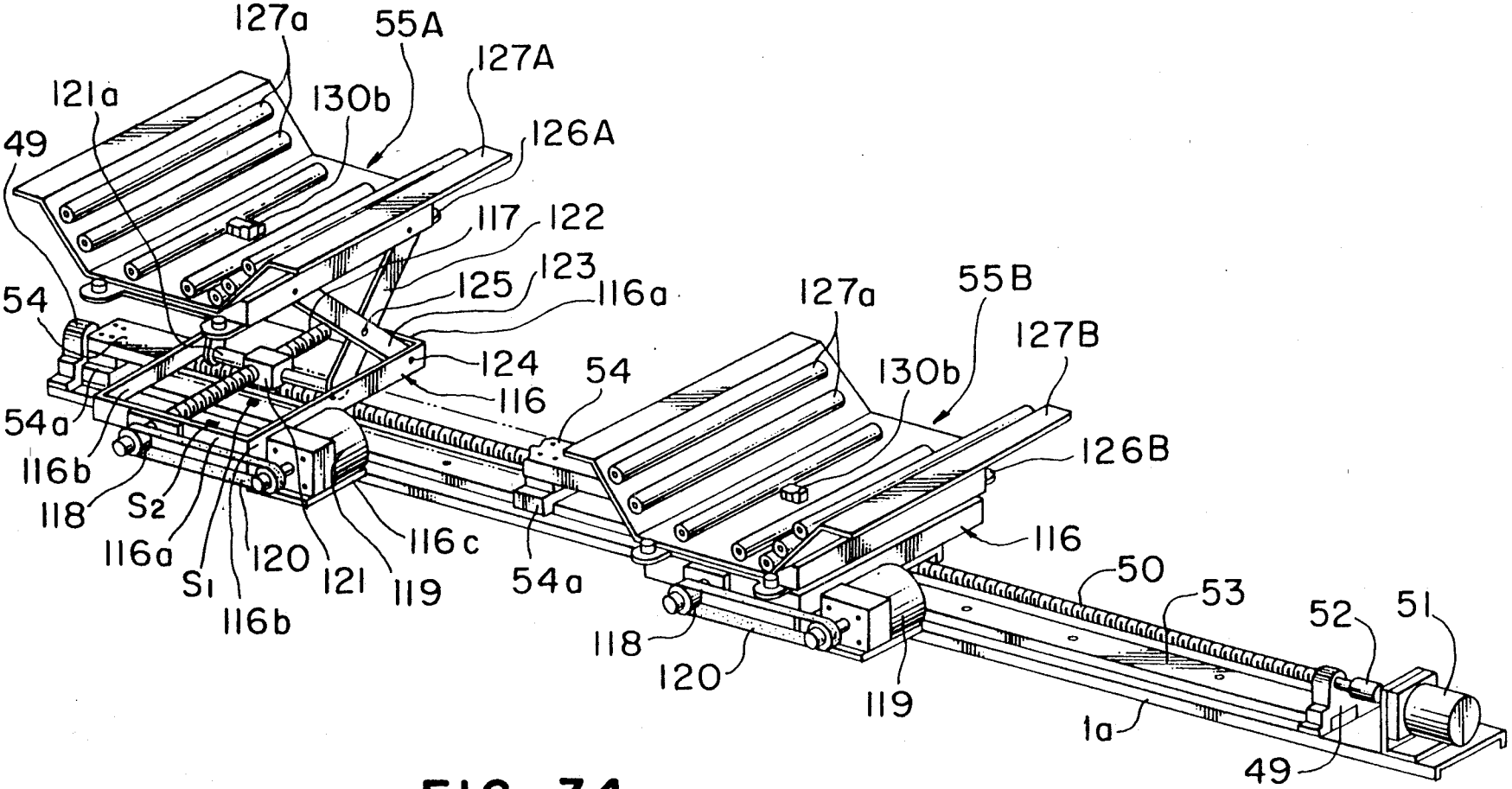
FIG. 34 is a perspective view showing a further modification of the fabric conveying device.

More specifically, in FIG. 34, the motor 119 of the first lifter device 55A operates whereby the motor 119 rotates the pulley 118 via the transmission belt 120 so that the lifting screw shaft 117 fixed to the pulley 118 moves the slider 121. As a result, the pressing rods 121*a* of this slider 121 press the lifting struts 122 and rotate them so that the lifting struts 122 and the other lifting struts 123 stand up around the center of the pin 125. Therefore, the receiving plate 127A and the first fabric receiving platform 126A that is mounted on the upper portion of the lifting struts 122 and 123 are raised to their upper limit positions, and a fabric detection switch 130*b* detects contact with the roll of the knitted fabric W and the operation of the motor 119 is stopped.

Then, when the takeup shafts 20 are pulled back toward the outside of the machine in the same manner as in the previous embodiment, the roll of knitted fabric W is gently placed on the receiving plate 127A. When this is done, the motor 119 operates in reverse, and via the transmission belt 120, this motor rotates the pulley 118 in reverse, so that the lifting screw shaft 117 of this pulley moves the slider 121 back to the original position. Then, the pressing rods 121*a* of this slider 121 move back together with the lifting struts 122 whereby the lifting struts 122 and 123 rotate around the center of the pin 125 and the receiving plate 127A and the first fabric receiving platform 126A are lowered to the bottommost position and stop there.

When the first fabric receiving platform 126A is lowered to, and stopped at the bottommost position, the switch $S_2$ operates the motor 51, and the feed screw 50 coupled to this motor 51 rotates. Consequently, as shown in FIG. 36, the first lifter device 55A on which is placed the first full roll of knitted fabric W, and the slider 54 that is threaded to the feed screw 50 move toward the outside while the second lifter device 55B moves to the initial position of the first lifter device 55A and stops there.

When the first full roll of knitted fabric W passes the above-described position for the cutter, the cutter unit moves reciprocatingly as described above, and cuts the trailing end portion of the knitted fabric W.

Figure 36:
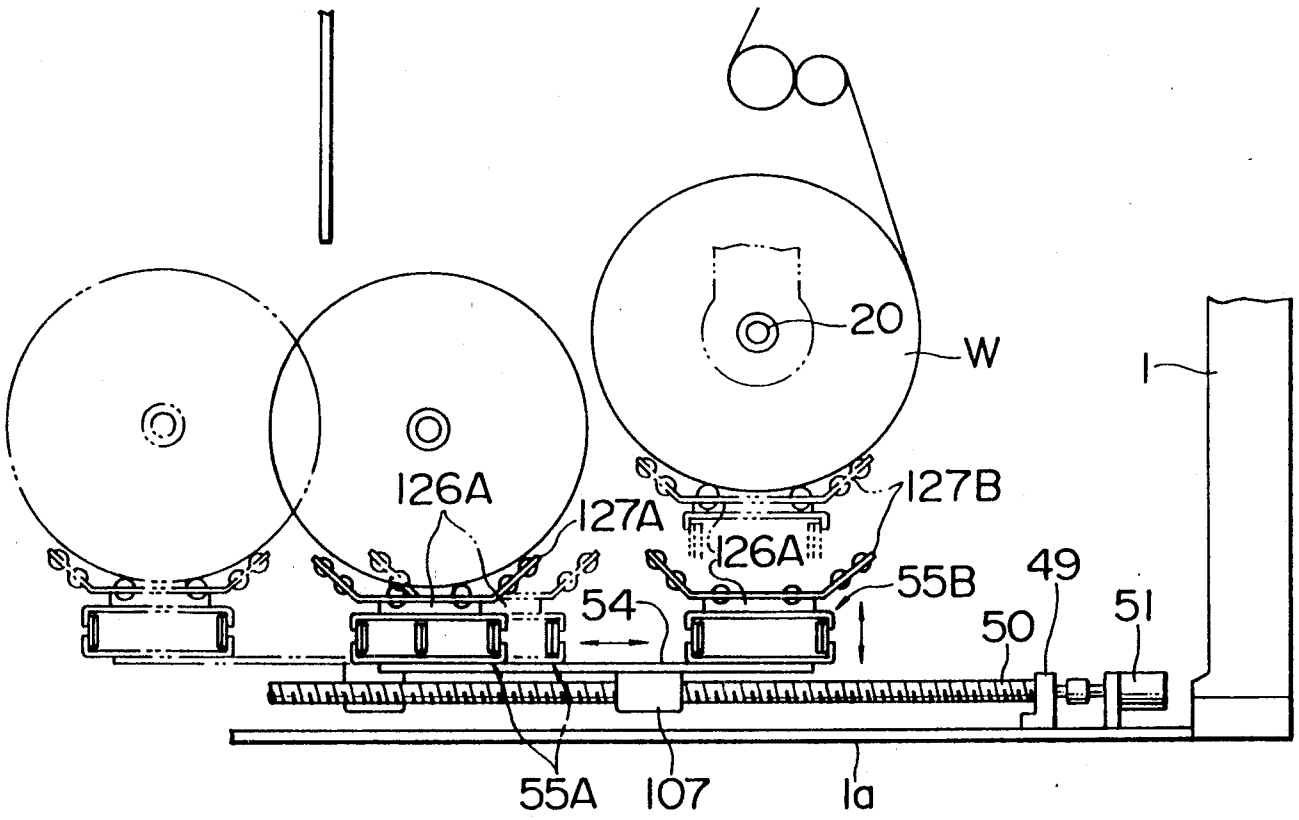
Figure 37:
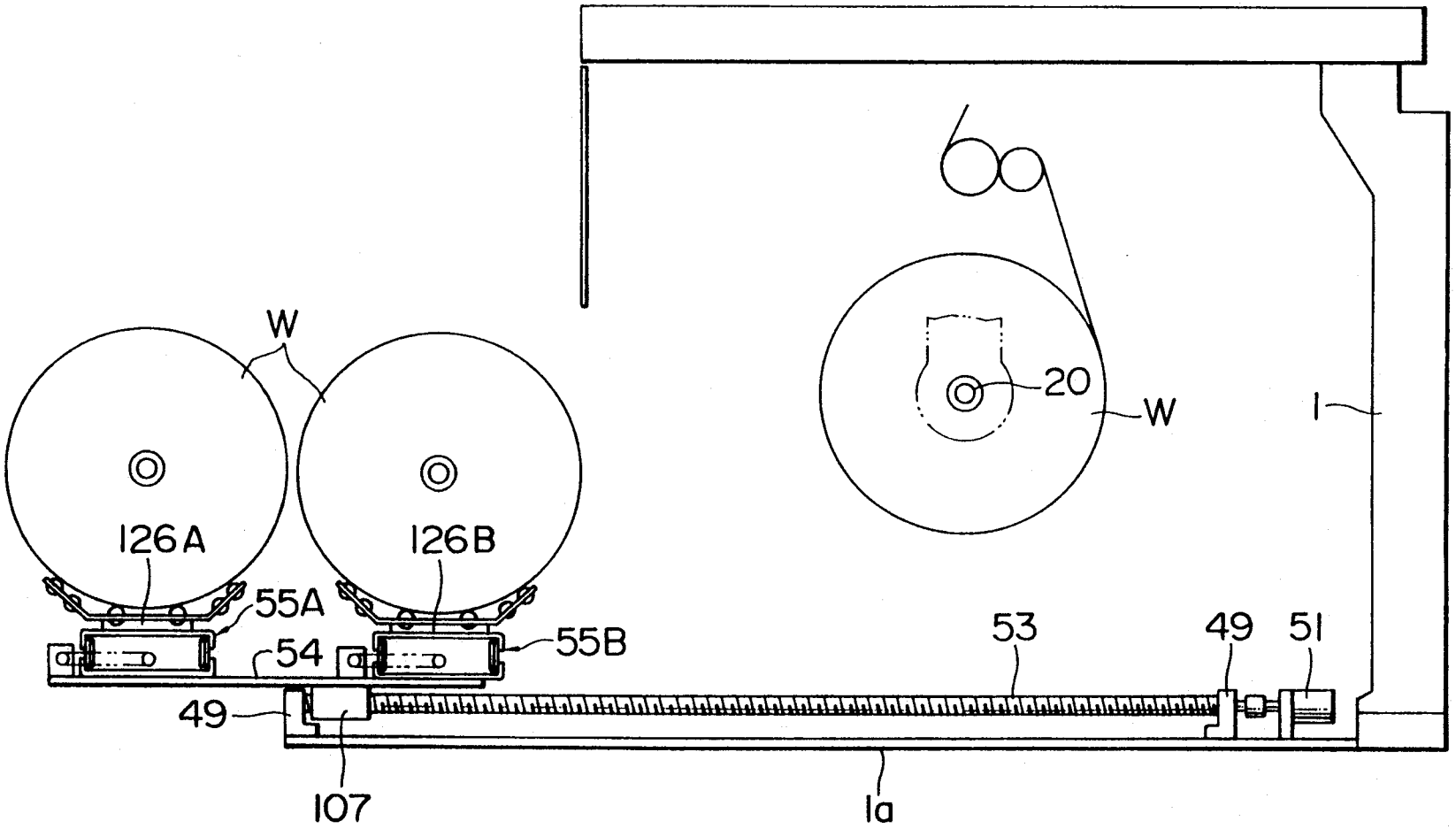

Then, the second lifter device 55B operates when the takeup shafts 20 have a second full roll of the knitted fabric W as shown in FIG. 36. More specifically, when the second full roll of the knitted fabric W is to be taken out, the second lifter device 55B is raised and comes into contact with the second full roll of knitted fabric W, and .after the second full roll of knitted fabric W has been transferred to the second fabric receiving plate 127B, the takeup shafts 20 are pulled outward and the second lifter device 55B lowers. After this, the feed screw 50 rotates and the slider 54 is moved to the outside. Then, when the second full roll of knitted fabric W passes the position of the cutter device, the trailing end portion of the second full roll of knitted fabric W is cut by the cutter device. After this, the second full roll of fabric is conveyed to the outside of the machine.

For the external diameter of the roll of knitted fabric W to reach approximately 40 cm it takes about 2.5 hours so that removing the full roll is performed about three times per day. Conveying the full roll to outside the machine can be performed together by placing the full rolls of knitted fabric W on the first lifter device 55A and the second lifter device 55B so that this conveying can involve a labor saving.

Figure 38:
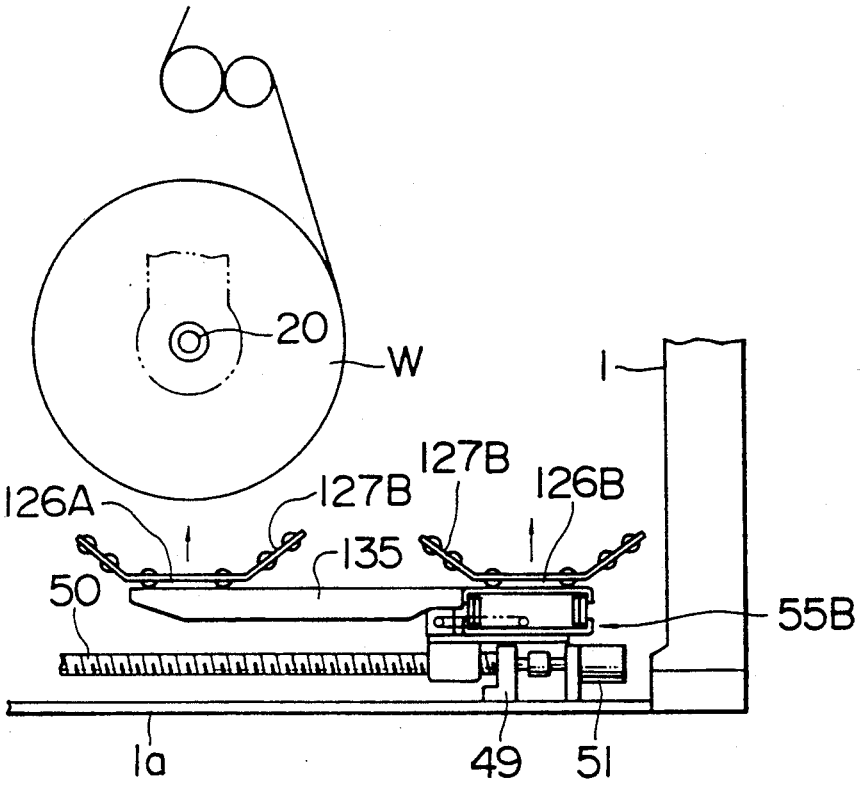
FIGS. 38, 39 and 40 are views showing successive different steps in the operation of another modification of the fabric conveying device.
Figure 39:
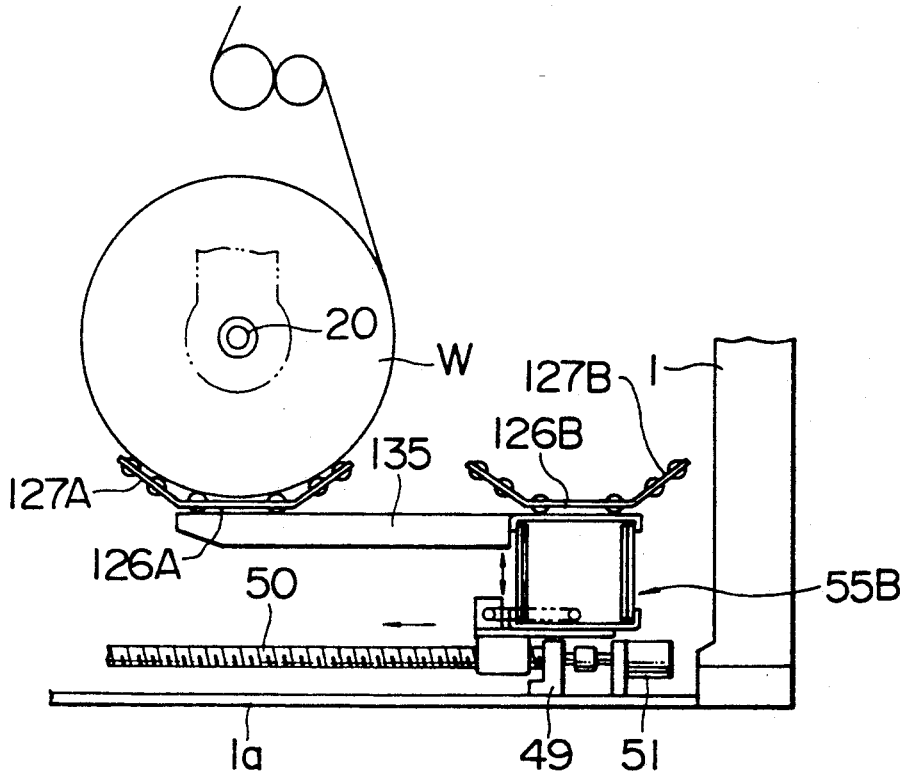
Figure 40:
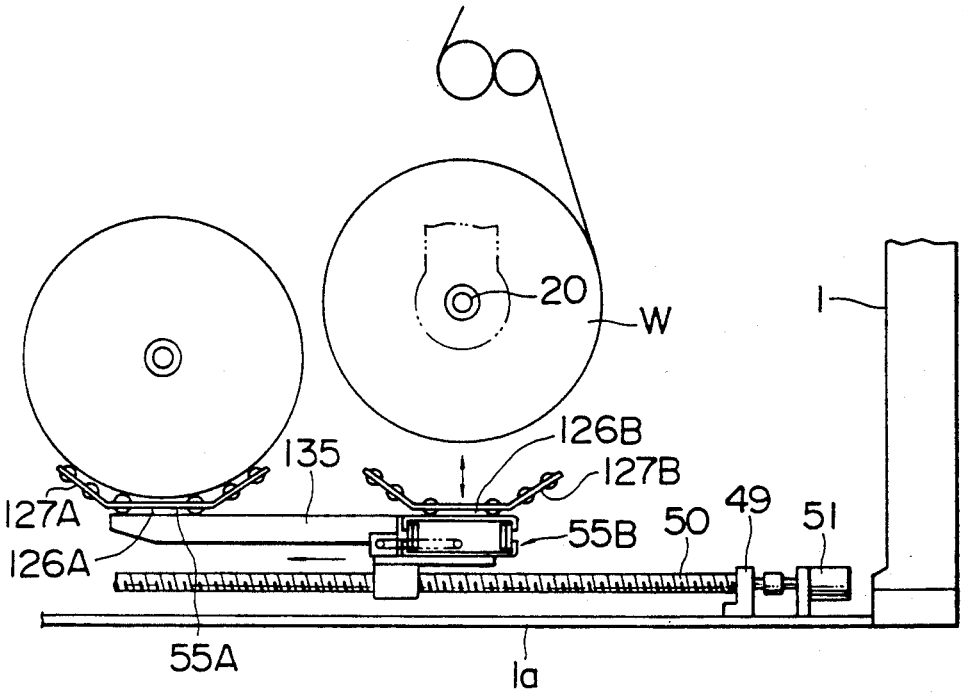
Figure 41:
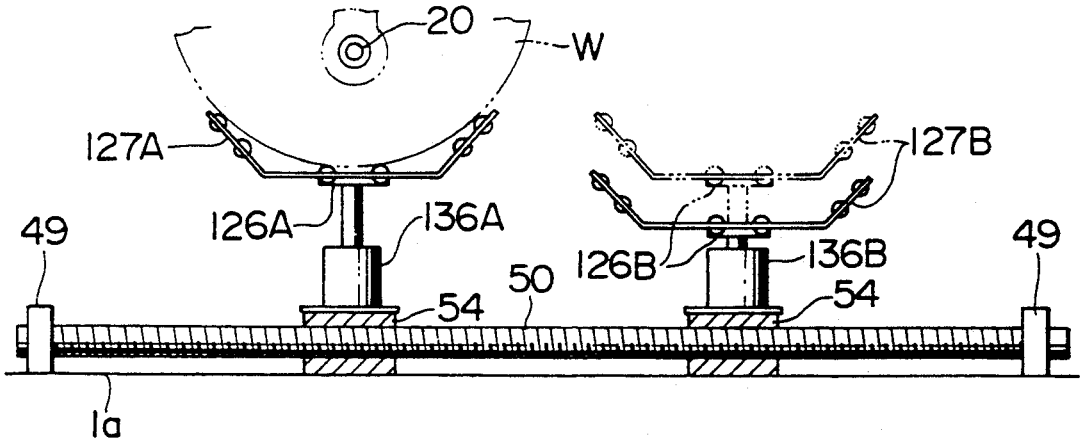
FIG. 41 is an elevational view showing still another modification of the fabric conveying device.

Another modification as shown in FIGS. 38 through 40 omits the pantograph mechanism of the first lifter device 55A, and a single cantilevered support 135 fixedly secured to the second lifter device 55B is extended horizontally to mount the first lifter device 55A thereon. The operation of this modification is as follows. When the first fabric receiving platform 126A and the receiving plate 127A are raised and lowered, the pantograph mechanism for the second lifter device 55B is used. Furthermore, also when the second fabric receiving platform 126B and the receiving plate 127B are raised and lowered, the same pantograph mechanism is used. Therefore, there is a simplification of the pantograph mechanism. Inspection and maintenance are therefore simplified when compared to the embodiment described above.

Finally, instead of the pantograph mechanism of the first lifter device 55A and the second lifter device 55B described above; another embodiment shown in FIG. 41 is provided with a first cylinder device 136A and a second cylinder device 136B that are either pneumatic or hydraulic cylinders. These cylinders are provided vertically to each of the sliders 54. To each of the output shafts of the first cylinder device 136A and second cylinder device 136B are respectively mounted a first fabric receiving platform 126A and a receiving plate 127A, and a second fabric receiving platform 126B and a receiving plate 127B. They operate in the same manner as described above.

In the previous embodiments, the first lifter device 55A and the second lifter device 55B are mounted on the upper portion of one of the slider 54, but the slider 54 can be divided into two and independently provided Furthermore, the first lifter device 55A and the second lifter device 55B may be respectively provided on each of these sliders 54, and the first lifter device and the second lifter device may raise and lower alternately so that each roll of knitted fabric W is received and taken out when it is full.

What is claimed is:

1. An apparatus for winding and conveying a knitted fabric produced in a knitting machine, having a pair of horizontally aligned takeup shafts disposed below said knitting machine to wind therearound the knitted fabric fed downwardly from the knitting machine, into a roll of the knitted fabric, said takeup shafts having opposite inner gripping ends normally thrust against each other to grip therebetween a lower starting end of the knitted fabric, said takeup shafts being shiftable outwardly away from each other and out of the roll formed therearound to release the roll, said apparatus comprising:

knitted fabric insertion means provided at one side of said takeup shafts so as to be extendable into, and retractable out of a region in which said gripping ends of the takeup shafts confront each other, said insertion means having a fabric thrust arm on a free distal end thereof;

drive means acting on the takeup shafts to shift the shafts toward and away from each other;

actuator means coupled to said knitted fabric insertion means to extend and retract the same, said actuator means being operable to extend the insertion means so as to push said fabric thrust arm into said lower starting end of the fabric, thereby to thrust a portion of said starting end into a gap between said gripping ends of the takeup shafts movable into confrontation with each other, whereby the starting end of the fabric is gripped by the gripping ends preparatory to the winding of the fabric around the takeup shafts;

means for cutting a trailing part of the fabric from the roll; and means for conveying the roll out of the knitting machine.

2. The apparatus according to claim 1, wherein said knitted fabric insertion means is a link mechanism.

3. The apparatus according to claim 2, wherein said link mechanism comprises a long first lever pivoted at one end thereof to a stationary part of the knitting machine, a short second lever pivoted at one end thereof to said stationary part at a position higher than said one end of the first lever, a third lever pivoted to the other ends of said first and second levers at different positions adjacent one end of the third lever, and a supporting lever pivoted at one end thereof to the other end of the third lever and pivotally supporting said fabric thrust arm at the other end thereof.

4. The apparatus according to claim 3, wherein said actuator means is connected to said first lever.

5. The apparatus according to claim 2, wherein said fabric thrust arm is pivotally supported on a distal end of said link mechanism in such a manner that the fabric thrust arm is pivotable upwardly but is prevented from pivoting downwardly beyond a predetermined substantially horizontal attitude.

6. The apparatus according to claim 1, wherein said drive means for shifting the takeup shafts are disposed outwardly of the respective takeup shafts with respect to the axial direction of the takeup shafts and comprises respective sliders movable inwardly and outwardly with respect to said axial direction, drive means coupled to said sliders for moving the sliders in said axial direction, and means for releasably engaging said sliders with the respective takeup shafts.

7. The apparatus according to claim 6, wherein said means for releasably engaging the sliders are engaging arms pivotally supported on the respective sliders and having engaging portions releasably engageable with outer ends of the takeup shafts, respectively.

8. The apparatus according to claim 6, wherein said sliders are slidably mounted on stand frames, respectively, and said drive means for the slider are provided in and on the stand frames, respectively.

9. The apparatus according to claim 1, further comprising lock means movable transversely to said takeup shafts to engage the respective takeup shafts so as to prevent the shafts from shifting outwardly and as to maintain the inner gripping ends of the shafts in a state thrust against each other.

10. The apparatus according to claim 1, wherein each of the inner gripping ends of the takeup shafts is formed from an elastomer member.

11. The apparatus according to claim 1, wherein said means for cutting comprises rack means movable across the width of said trailing part of the fabric, a pinion meshing with said rack means, drive means for driving said pinion in one and the other directions, and a cutter unit supported on one end of said rack means for cutting said trailing part as the rack means is moved.

12. The apparatus according to claim 11, wherein said rack means comprises an upper rack unit and a lower rack unit which supports thereon the upper rack unit in a manner slidable relative to the lower rack unit, the relation of the rack units to said pinion being such that when the upper rack unit has been moved by the pinion toward the trailing part of the fabric to a limit the pinion begins to mesh with the lower rack unit to move the same together with the upper rack unit, said cutter unit being mounted on the upper rack unit.

13. The apparatus according to claim 11, wherein said cutter unit is supported on one end of a support lever pivotally connected to said one end of the rack means so as to be swingable horizontally relative to the rack means, said support lever extending at an angle with the length of the rack means when the rack means is retracted away from said trailing part of the fabric so that the cutter unit on said one end of the support lever is at a position offset from a path of the rack means, and wherein means are provided to cause the support lever to swing into alignment with the rack means responsive to movement of the rack means toward said trailing part of the fabric whereby the cutter unit is brought onto said path of the rack means.

14. The apparatus according to claim 13, wherein said means to cause the support lever to swing comprises a pulling arm pivoted at one end thereof to an intermediate portion of said support lever and extending horizontally, spring means joined to the other end of the pulling arm to urge the pulling arm toward the rack means, and abutment means for preventing the pulling arm to swing toward the rack means beyond a limit only when the rack means is retracted away from the trailing part of the fabric whereby when the rack means is moved toward said trailing part, the pulling arm is allowed to swing further toward the rack means so that the support lever is caused to swing into alignment with the rack means.

15. The apparatus according to claim 1, wherein said means for conveying the roll comprises a guide extending from below the knitting machine to the outside, a slider movable along the guide, lifter means provided on the slider and having a fabric receiving plate capable of being raised to receive said roll thereon and being lowered, and motor means for moving the slider and the lifter means along the guide.

16. The apparatus according to claim 15, further comprising another slider movable along said guide, another lifter means provided on said other slider and having a fabric receiving plate capable of being raised and lowered, said motor means also moving the other slider and the other lifter means along the guide.

17. The apparatus according to claim 1, wherein said means for conveying the roll comprises a guide extending from below the knitting machine to the outside, a slider movable along the guide, a plurality of lifter means provided at intervals on the slider and each having a fabric receiving plate capable of being raised to receive said roll thereon and being lowered, and motor means for moving the slider and all the lifter means along the guide.

* * * * *